US008002268B2

(12) United States Patent
Sonoda et al.

(10) Patent No.: US 8,002,268 B2
(45) **Date of Patent: *Aug. 23, 2011**

(54) SHEET FEEDING DEVICE AND RECORDING APPARATUS WITH SEPARATING MEANS

(75) Inventors: Shinya Sonoda, Yokohama (JP); Yasutsugu Saijo, Tokyo (JP); Yoshinori Watanabe, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/480,282

(22) Filed: Jun. 8, 2009

(65) Prior Publication Data

US 2009/0243195 A1 Oct. 1, 2009

Related U.S. Application Data

(62) Division of application No. 12/047,822, filed on Mar. 13, 2008, now Pat. No. 7,559,546, which is a division of application No. 11/349,100, filed on Feb. 8, 2006, now Pat. No. 7,374,162, which is a division of application No. 10/366,508, filed on Feb. 14, 2003, now Pat. No. 7,040,614.

(30) Foreign Application Priority Data

Feb. 18, 2002 (JP) ..... 2002-040089
Jun. 7, 2002 (JP) ..... 2002-166825

(51) Int. Cl.
*B65H 3/52* (2006.01)

(52) U.S. Cl. ..... 271/121; 271/122; 271/161

(58) Field of Classification Search ..... 271/161, 271/125, 121, 122, 124, 126, 127; 347/104
See application file for complete search history.

(56) References Cited

U.S. PATENT DOCUMENTS

| | | | | |
|---|---|---|---|---|
| 4,928,951 | A | 5/1990 | Fukui | 271/113 |
| 5,470,052 | A | 11/1995 | Asakawa et al. | 271/118 |
| 5,476,255 | A | 12/1995 | Murcko et al. | 271/109 |
| 5,655,762 | A | 8/1997 | Yergenson | 271/121 |
| 5,725,208 | A | 3/1998 | Miyauchi | 271/10.09 |
| 5,738,452 | A | 4/1998 | Uchida | 400/624 |
| 5,996,990 | A | 12/1999 | Kawashima | 271/122 |
| 5,997,198 | A | 12/1999 | Murayama et al. | 400/624 |
| 6,000,689 | A | 12/1999 | Furuki et al. | 271/10.11 |

(Continued)

FOREIGN PATENT DOCUMENTS

JP 60-209447 10/1985

(Continued)

*Primary Examiner* — Jeremy Severson
(74) *Attorney, Agent, or Firm* — Fitzpatrick, Cella, Harper & Scinto

(57) ABSTRACT

A sheet material feeding apparatus includes a sheet stacking portion for stacking recording sheets; a feeding roller for feeding the recording sheets from the sheet stacking portion; separating means for separating the recording sheet fed out by the feeding roller; a holder for holding the separating means, the holder being rotatably supported on a main assembly of the apparatus; first urging means for urging the holder toward the feeding roller; a preliminary regulating member, rotatably supported on the holder, for regulating a gap relative to the feeding roller; second urging means for urging the preliminary regulating member toward the feeding roller; a first regulating member, supported by the holder, for regulating rotation of the preliminary regulating member relative to the holder; and a second regulating member, provided in the main assembly of apparatus, for regulating rotation of the preliminary regulating member relative to the main assembly of the apparatus.

8 Claims, 26 Drawing Sheets

U.S. PATENT DOCUMENTS

| | | | | |
|---|---|---|---|---|
| 6,022,012 | A | 2/2000 | Worley | 271/3.14 |
| 6,059,281 | A | 5/2000 | Nakamura et al. | 271/119 |
| 6,082,729 | A | 7/2000 | Padget | 271/121 |
| 6,331,002 | B1 | 12/2001 | Yoshino et al. | 271/117 |
| 6,382,621 | B1 | 5/2002 | Inoue et al. | 271/120 |
| 6,382,857 | B1 | 5/2002 | Yanagi et al. | 400/636 |
| 6,467,767 | B2 | 10/2002 | Yano | 271/122 |
| 6,547,237 | B2 | 4/2003 | Sugino et al. | 271/119 |
| 6,824,132 | B2 | 11/2004 | Asai et al. | 271/125 |
| 6,902,161 | B2 | 6/2005 | Gordon et al. | 271/161 |
| 7,559,546 | B2 * | 7/2009 | Sonoda et al. | 271/121 |
| 2002/0175462 | A1 | 11/2002 | Sonoda et al. | 271/121 |

FOREIGN PATENT DOCUMENTS

| | | |
|---|---|---|
| JP | 62-105834 | 5/1987 |
| JP | 6-179540 | 6/1994 |
| JP | 6-191649 | 7/1994 |
| JP | 11-049377 | 2/1999 |

* cited by examiner

SHEET FEEDING DEVICE AND RECORDING APPARATUS WITH SEPARATING MEANS

CROSS-REFERENCE TO RELATED APPLICATIONS

This application is a divisional of U.S. patent application Ser. No. 12/047,822, filed Mar. 13, 2008, which is a divisional of application Ser. No. 11/349,100, filed Feb. 8, 2006, now U.S. Pat. No. 7,374,162, which is a divisional of application Ser. No. 10/366,508, filed Feb. 14, 2003, now U.S. Pat. No. 7,040,614, and claims benefit of the filing dates of those applications, and priority benefit of the filing dates of Japanese Patent Applications Nos. 2002-040089, filed Feb. 18, 2002, and 2002-166825, filed Jun. 7, 2002. The entire disclosures of those five prior applications are incorporated herein by reference.

BACKGROUND OF THE INVENTION

Field of the Invention

The present invention relates to a sheet feeding apparatus, which picks the recording sheets in the recording sheet holding portion of a recording apparatus out of the recording sheet holding portion, and conveys the recording sheets one by one.

Shown in FIG. 24 is one of various conventional sheet feeding apparatuses, which is disclosed in Japanese Laid-Open Patent Application 60-209447. In FIG. 24, reference numeral 201 stands for a feed roller, and reference numeral 202 stands for a frictional member kept pressed on the feed roller 201. With the presence of the difference in the friction against a recording sheet S between the feed roller 201 and frictional roller 202, the two or more recording sheets S can be separated from the sheet S immediately below, and fed into a recording apparatus one by one. The frictional member 202 is such that when the coefficient of friction between the frictional member 202 and recording sheet S is $\mu 1$, the coefficient of friction between the feed roller 201 and recording sheet S is $\mu 2$, and coefficient of friction between the adjacent two recording sheets S1 and S2 is $\mu 3$, the following relationship is satisfied: $\mu 1>\mu 2>\mu 3$.

As the recording sheet S1, that is, the topmost recording sheet, is sent into the nipping portion between the feed roller 201 and frictional member 202, the recording sheet S1 is fed into the recording apparatus, due to the difference between the coefficient of friction between the feed roller 201 and recording sheet S1, and the coefficient of friction between the frictional member 202 and recording sheet S1 ($\mu 1>\mu 2$).

As two recording sheets S1 and S2 are sent into the nipping portion between the feed roller 201 and frictional member 202, only the first recording sheet S1 is fed into the recording apparatus, while sliding on the second recording sheet S2, since the second recording sheet S2 is prevented by the frictional member 202 from advancing, due to the difference among the coefficient of friction between the feed roller 201 and recording sheet S1, coefficient of friction between the frictional member 202 and recording sheet S2, and coefficient of friction between the recording sheet S1 and S2 ($\mu 1>\mu 2>\mu 3$).

Shown in FIG. 25 is the sheet feeding apparatus recorded in Japanese Laid-Open Patent Application 62-105834. In FIG. 25, reference numeral 301 stands for a feed roller, and reference numeral 302 stands for a separation roller kept pressed on the feed roller 301. The feed roller 301 is provided with a torque limiter so that the recording sheets S are separated one by one by the braking torque of the torque limiter, and then, are fed into the recording apparatus. In this case, the sheet feeding apparatus is designed so that the following relationships are satisfied:

$$\mu 4 \geqq \mu 5>\mu 6$$

$$\mu 5 \times N>T1/r>\mu 6 \times N$$

$\mu 4$: coefficient of friction between feed roller 301 and recording sheet S $\mu 5$: coefficient of friction between separation roller 302 and recording sheet S $\mu 6$: coefficient of friction between two recording sheets S T1: braking torque of torque limiter N: contact pressure between separation roller 302 and feed roller 301 r: radius of separation roller 302.

As the recording sheet S1, that is, the topmost recording sheet, is sent into the nipping portion between the feed roller 301 and separation roller 302, the torque applied to the separation roller 302 by the feed roller 301 through the recording sheet S1 becomes greater than the predetermined value of the braking torque T1 of the torque limiter of the separation roller 302. As a result, the separation roller 302 is rotated by the rotation of the feed roller 301, advancing the recording sheet S1. As two recording sheets S1 and S2 are sent into the nipping portion between the feed roller 301 and separation roller 302, the recording sheet S1 slides on the recording sheet S2, preventing the torque applied to the separation roller 302 by the feed roller 301 from becoming greater than the predetermined value of the braking torque T1 of the torque limiter of the separation roller 302. Therefore, the separation roller 302 does not rotate, preventing thereby the second recording sheet S2 from advancing. As a result, only the recording sheet in contact with the feed roller 301, that is, the recording sheet S1, is allowed to advance; the recording sheet S2 in contact with the separation roller 302 is prevented from advancing, by the separation roller 302 remaining stationary.

However, as three or more recording sheets S are sent into the nipping portion between the feed roller 201 and frictional member 202 of the sheet feeding apparatus shown in FIG. 24, the following situation occurs. Since $\mu 1>\mu 3$, the topmost recording sheet S1 is allowed to advance. Further, $\mu 2>\mu 3$. Therefore, the third recording sheet S3 is prevented by the frictional member 202 from advancing. Meanwhile, the second recording sheet S2 is in contact with the first and third recording sheets S1 and S3, and the friction between the first and second recording sheets S1 and S2 is virtually equal to the friction between the second and third recording sheets S2 and S3. Therefore, it is not ensured that the second recording sheet S2 is prevented by the frictional member 202 from advancing.

A situation similar to the above described one also occurs as three or more recording sheets S are sent into the nipping portion between the feed roller 301 and separation roller 302 of the sheet feeding apparatus shown in FIG. 25; it is not assured that all the recording sheets S are fed into the recording apparatus one by one.

FIG. 26 shows one of the sheet feeding apparatuses designed to prevent the occurrence that three or more recording sheets S are sent into the nipping portion between the feed roller 301 and separation roller 302. More specifically, the apparatus in FIG. 26 is provided with a pre-regulating member 304, which is disposed between the nipping portion between the feed roller 301 and separation roller 302, and the contact area between the feed roller 301 and the topmost recording sheet S in the recording sheet holding means 303, being solidly fixed to a base member 305 or an unshown separation roller holder, so that the gap H between the tip of the preregulating member and the peripheral surface of the feed roller 301 becomes optimum.

However, sheet feeding apparatuses like the above described one shown in FIG. 26 have the following problems, because the preregulating member is solidly fixed to the base or separation roller holder.

That is, the feed roller 301 is subjected to a contact pressure F1 (approximately 300 gf-500 gf) generated as the feed roller 301 is kept pressed on the recording sheet holding means, and a contact pressure F2 (approximately 100 gf-300 gf) generated as the feed roller 301 is kept pressed upon the separation roller 302. As a result, the feed roller 301 sometimes becomes deformed. In particular, in the case of the sheet feeding apparatuses structured so that the preregulating member is fixed to the base, as the feed roller 301 becomes deformed, the gap between the feed roller 301 and preregulating member becomes larger, allowing sometimes three or more recording sheets S to be sent into the nipping portion between the feed roller 301 and separation roller 302.

Further, in the case of the sheet feeding apparatuses structured so that the preregulating member is solidly fixed to the separation roller holder, even after the deformation of the feed roller 301, the separation roller 302, separation roller holder, and preregulating member follow the feed roller 301. Therefore, the gap between the feed roller 301 and preregulating member does not change. However, as the feed roller 301 deforms, it becomes possible that the preregulating member enters the area occupied by the feed roller 301 prior to its deformation, coming into contact with the feed roller 301, which results in the shaving of the rubber layer of the feed roller 301 by the preregulating member, and/or the damage to the preregulating member.

As for a sheet separating method employed by a sheet feeding apparatus having a sheet separating mechanism, there are: a friction plate method, a retard roller method, etc. A sheet feeding apparatus employing a friction plate method has a friction plate, and separates sheets using the difference in coefficient of friction among the feed roller, sheet, and friction plate. In the case of a sheet feeding apparatus employing a retard roller method, the separation roller is equipped with a torque limiter, and sheets are separated using the friction caused by the torque limiter and the coefficient of friction of the separation roller.

FIG. 27 is a schematic sectional view of the sheet separating portion of a sheet feeding apparatus structured in accordance with the prior art. The working of a sheet feeding apparatus employing the above described sheet separating method is as follows. A plurality of recording sheets 420 are held slanted in the sheet slot of the sheet feeding apparatus, with their leading edges in contact with the leading edge alignment reference portion 415. Further, the recording sheets 420 are kept pressured toward the feed roller 411 by the pressure from the pressure plate 416, with the topmost recording sheet 420 being in contact with the feed roller 411. As the sheet feeding apparatus is driven, the recording sheets 412 are conveyed to the separating means 412 past the preregulating member 422*a* held by the preregulating member holder 422 located on the upstream side of the sheet separating means 412 in terms of the sheet conveyance direction.

In the case of a sheet feeding apparatus such as the one described above, the sheets 420 are held slanted. Therefore, a recording sheet 420 comes into contact with the separating means 412 at a certain angle $\alpha$ relative to the separating means 412. Thus, it is assured by the above described preregulating member 422*a* that this angle does not exceed a predetermined value.

However, in the case of the above described sheet feeding apparatus in accordance with the prior art, a predetermined amount of gap is provided between the preregulating member 422*a* and feed roller 411, as shown in FIG. 27. Therefore, the preregulating member 422*a* alone is not sufficient to perfectly control the angle $\alpha$ of the sheet 420; the angle $\alpha$ between a certain portion or portions of the leading end portion of the sheet 420 and the separating means 412 becomes greater than the optimum angle. In particular, when a piece of cardboard is fed as a recording sheet, or a curled sheet is fed, with its leading edge curling downward, its leading edge collides with the separating means 412, preventing sometime the recording sheet from conveyed. Further, when a thin sheet is sent in, its leading edge sometimes becomes folded back, as it comes into contact with the separating means.

As a means for preventing the sheet conveyance failure, it is effective to increase the external diameter of the feed roller 411. Further, in the case of a sheet feeding apparatus employing a separation roller as the separating means 412, it is also effective to increase the diameter of the separation roller. However, such solutions contradict the effort to reduce the size of a sheet feeding apparatus, as well as a recording apparatus.

As for another means for preventing the sheet conveyance failure, it is effective to tilt the pressure plate 416 in the direction to reduce the angle of the pressure plate 416 to reduce the angle at which the sheets are sent into the separating portion. This solution also contradicts the effort to reduce the size of a sheet feeding apparatus, as well as a recording apparatus.

SUMMARY OF THE INVENTION

The primary object of the present invention is to provide a sheet feeding apparatus, in which the gap between the feed roller and preregulating member remains constant, and which is stable in sheet conveyance performance.

Another object of the present invention is to provide a sheet material feeding device and a recording apparatus having the same, wherein failure of thick sheet feeding and curling of a leading end portion of the recording material when a shall diameter roller is used.

According to an aspect of the present invention, there is provided a sheet material feeding apparatus comprising a sheet stacking portion for stacking recording sheets; a feeding roller for feeding the recording sheets from said sheet stacking portion; separating means for separating the recording sheet fed out by said feeding roller; a holder for holding said separating means, said holder being rotatably supported on a main assembly of said apparatus; first urging means for urging said holder toward said feeding roller; a preliminary regulating member, rotatably supported on said holder, for regulating a gap relative to said feeding roller; second urging means for urging said preliminary regulating member toward said feeding roller; a first regulating member, supported by said holder, for regulating rotation of said preliminary regulating member relative to said holder; and a second regulating member, provided in the main assembly of apparatus, for regulating rotation of said preliminary regulating member relative to the main assembly of said apparatus.

According to another aspect of the present invention, there is provided a sheet material feeding apparatus comprising: a sheet material stacking portion for stacking sheet materials; feeding means for feeding the sheet materials from said sheet material stacking portion; separating means for separating the sheet materials fed out by said feeding means to single out the recording material; a preliminary regulating member for limiting number of sheets entering said separating means; an attitude control member for controlling an attitude of the sheet material fed toward said separating means, wherein said attitude control member is disposed at a position not interfering with said feeding means and said separating means with respect to a widthwise direction of the sheet material such that it has a height to be substantially flush with a sheet material feeding plane of said feeding means or to enter said sheet material feeding with respect to a direction crossing with the widthwise direction of the sheet material.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the embodiments of the present invention will be described with reference to the appended drawings.

Embodiment 1

A sheet feeding apparatus in accordance with the present invention is to be used as a sheet feeding apparatus for an image forming apparatus such as a printer, a copying machine, a facsimileing machine, etc. It is an apparatus for separating a plurality of recording mediums in the form of a sheet, for example, sheets of recording paper, sheets of recording film, originals in the form of a sheet as objects to be read, etc., held in a recording medium holding means, and feeding them one by one into the image forming portion, or image reading portion, of an image forming apparatus. This embodiment of the present invention will be described with reference to an image forming apparatus equipped with a sheet feeding apparatus which feeds a single or plurality of medium in the form of a sheet, on which an image is formed, into the image forming portion of the image forming apparatus.

Figure 1:
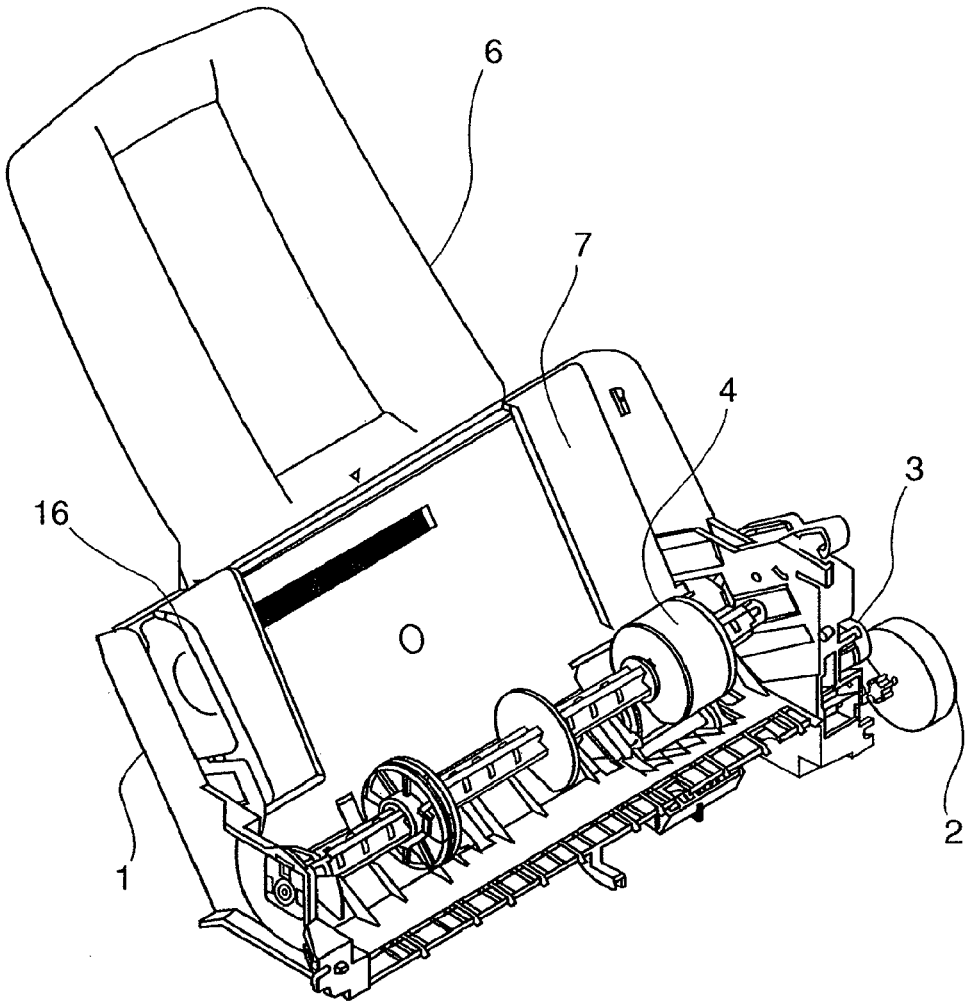
FIG. 1 is a perspective view of the entirety of the first embodiment of a sheet feeding apparatus in accordance with the present invention.
Figure 2:
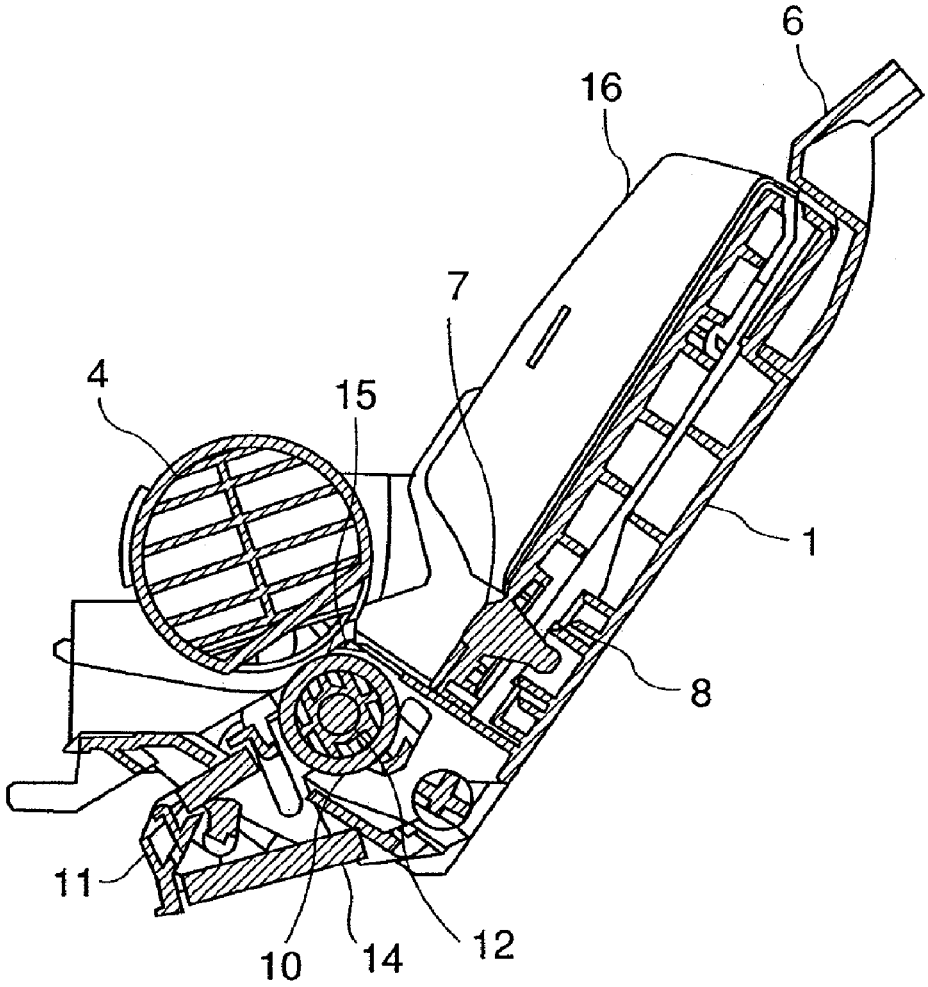
FIG. 2 is a sectional view of a sheet feeding apparatus.
Figure 3:
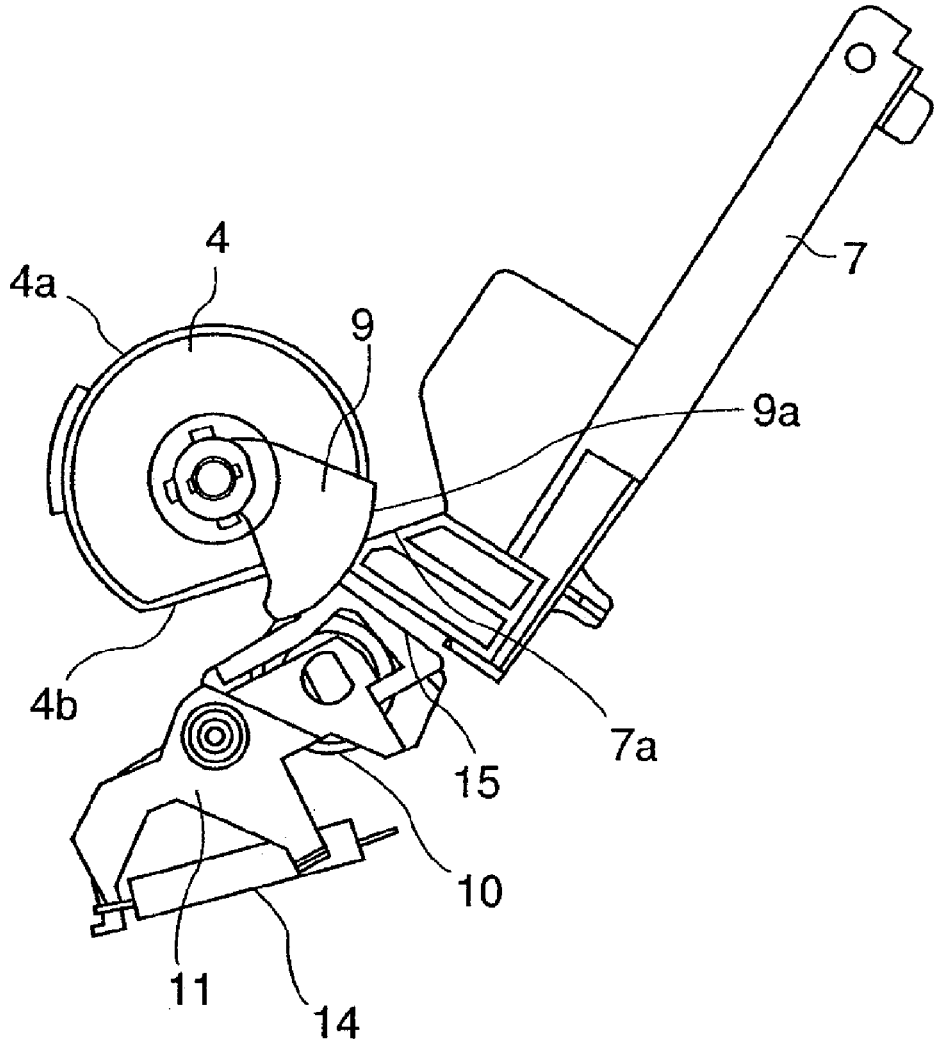
FIG. 3 is a sectional view of a sheet feeding apparatus.

FIG. 1 is a perspective view of the entirety of the first embodiment of a sheet feeding apparatus in accordance with the present invention. FIGS. 2 and 3 are sectional views of the sheet feeding apparatus. In the drawings, reference numeral 4 designates a sheet feeding roller (which hereinafter will be referred to simply as feed roller), which is rotationally supported by a base member 1, by its lengthwise end portions, and is rotationally driven by the driving force transmitted thereto from a mechanical power source through a transmitting means. A recording sheet S is fed into the main apparatus of an image forming apparatus by the feed roller 4, and is conveyed toward a conveying roller 5 located downstream in terms of the recording sheet conveyance direction. The portion of the feed roller 4, with which a recording sheet S comes into contact, is coated with a highly frictional substance such as rubber or foamed urethane. Referring to FIG. 3, in order to reduce the cost of a sheet feeding apparatus by simplifying in structure the mechanical power source 2 and the driving force switching mechanism of the transmitting means 3, and also to make it easier for a user to set recording sheets in the sheet feeding apparatus, the feed roller 4 is given a D-shaped cross section; the functional surface of the feed roller 4 is formed of a cylindrical portion 4*a*, which makes contact with a recording sheet S as the feed roller 4 rotates, and a flat portion 4*b*, which holds a certain distance from a recording sheet S in a sheet holding means, even when it faces the recording sheet S. The flat portion 4*b* may be referred to as the small diameter portion.

Designated by reference numeral 6 is a sheet feeding tray, which functions as a sheet holding means. Designated by reference numeral 7 is a pressure plate kept pressured toward the feed roller 4 by a pressing means, being pivotally attached to the base 1. The shaft of the feed roller 4 has a pressure plate regulation cam 9. The pressure plate 7 has a cam follower 7*a*, which is in contact with the pressure plate regulation cam 9 of the feed roller 4. The pressure plate 7 is placed in contact with, or moved away from, the feed roller 4 by the combination of the pressure plate regulation cam 9 and cam follower 7*a*. Further, the pressure plate 7 has a side guide for regulating the movement of a recording sheet S in the widthwise direction of the recording sheet S.

Figure 4:
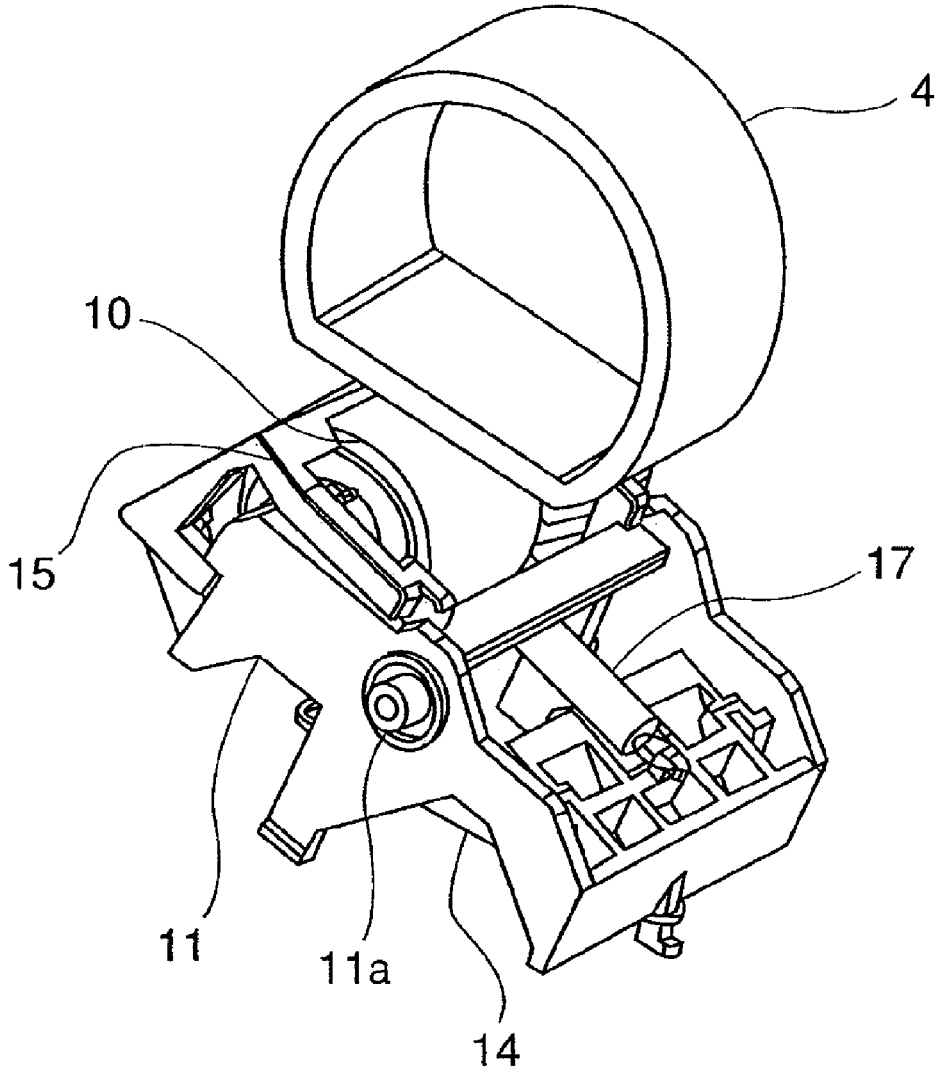
FIG. 4 is a perspective view of the sheet separating portion of the sheet feeding apparatus, for showing the structure thereof.
Figure 5:
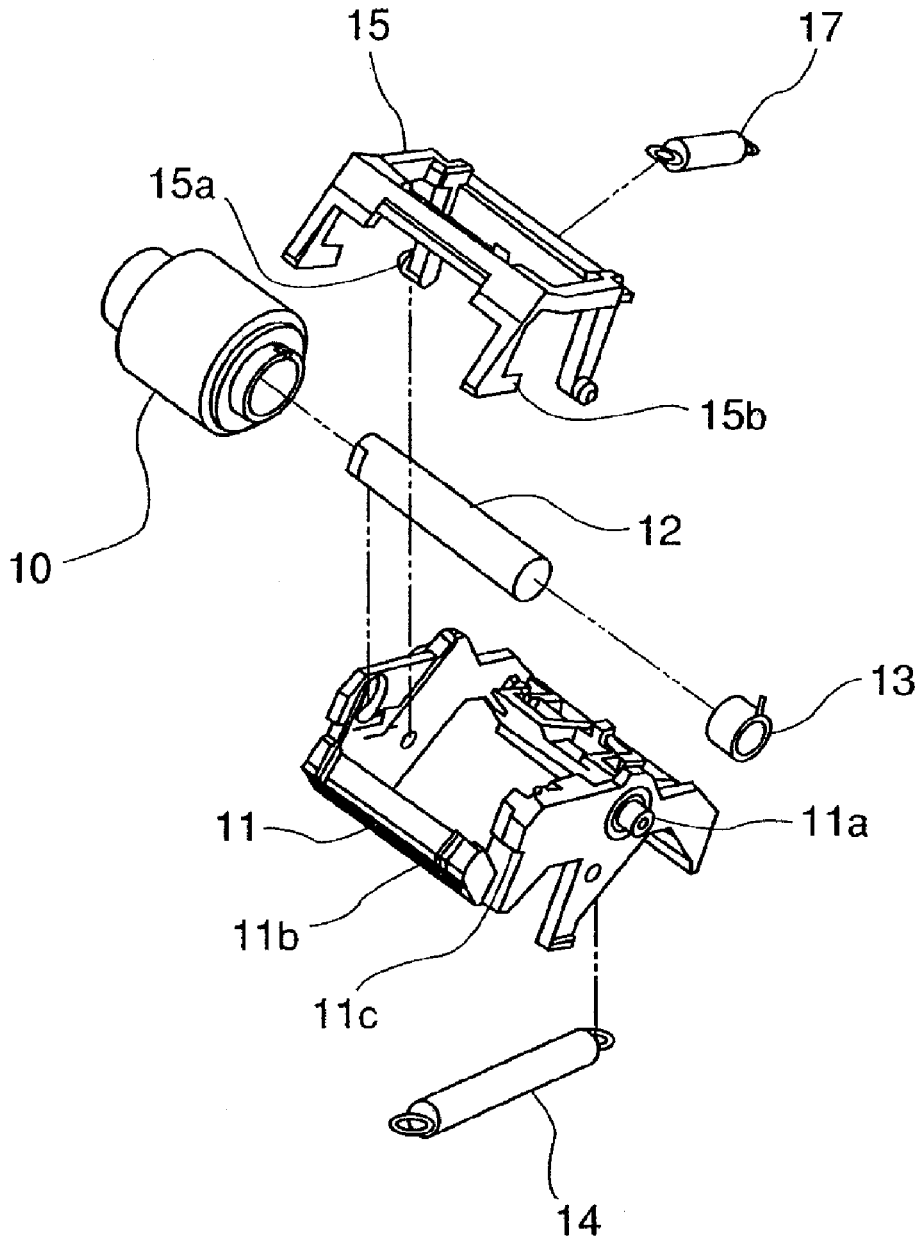
FIG. 5 is a perspective view of the sheet separating portion of the sheet feeding apparatus, for showing the structure thereof.
Figure 6:
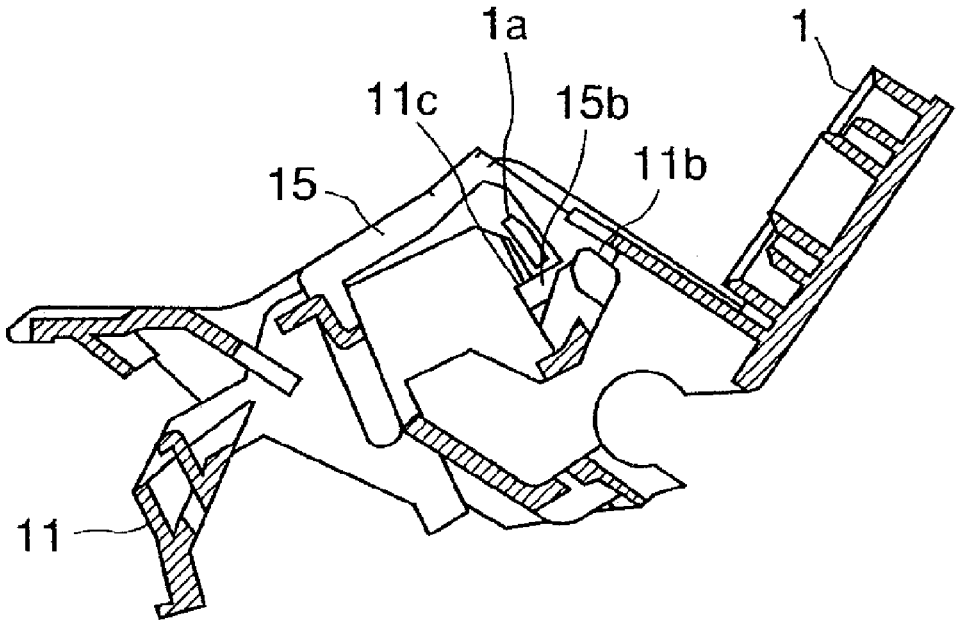
FIG. 6 is a perspective view of the sheet separating portion of the sheet feeding apparatus, for showing the structure thereof.

Referring to FIGS. 4-6, a sheet separating roller (or simply, separation roller) 10 is disposed downstream of the pressure plate 7 in terms of the recording sheet conveyance direction. The separation roller 10 is in contact with the feed roller 4. The coefficient of friction between the separation roller 10 and a recording sheet S is μ5. The separation roller 10 is fitted around a limiter shaft 12 solidly fixed to a separation roller holder 11. The limiter shaft 12 has a limiter spring 13, so that as the torque T1 applied to the separation roller 10 (hence, limiter shaft 12) exceeds a predetermined level, the separation roller 10 rotates around the limiter shaft 12. The separation roller holder 11 is fitted around the shaft 11*a*, being allowed to pivot about the shaft 11*a* solidly attached to the base member 1. The separation roller holder 11 is kept pressured toward the feed roller 4 by a separation roller holder pressing means 14. Further, the separation roller holder 11 has a bumper 11*b*, which comes into contact with the base member 11 to regulate the movement of the separation roller holder 11 toward the feed roller 4. The separation roller holder 11 has a preregulating member 15 capable of rotating about the shaft 15*a*. The preregulating member 15 is kept pressured toward the feed roller 4 by the pressure generating member 17. Further, preregulating member 15 has a bumper 15*b*. The separation roller holder 11 and base member 1 have a regulating member 11*c* and regulating member 1*a*, respectively, which correspond in position to the bumper 15*b* of the preregulating member 15. The contact between the bumper 15*b* and regulating member 11*c* assures that the angle of the preregulating member 15 relative to the separation roller holder 11 is kept at a predetermined angle. Further, the contact between the bumper 15*b* and regulating member 1*a* assures that the angle of the preregulating member 15 relative to the base member 1 is kept at a predetermined angle. This sheet feeding apparatus has been designed to satisfy the following relationships:

$$\mu 4 \geqq \mu 5 > \mu 6$$

$$\mu 5 \times N > T1/r > \mu 6 \times N$$

μ4: coefficient of friction between feed roller 4 and recording sheet S

μ6: coefficient of friction between two recording sheets S

T1: braking torque of torque limiter

N: contact pressure of separation roller 10 r: radius of separation roller 10.

Figure 7:
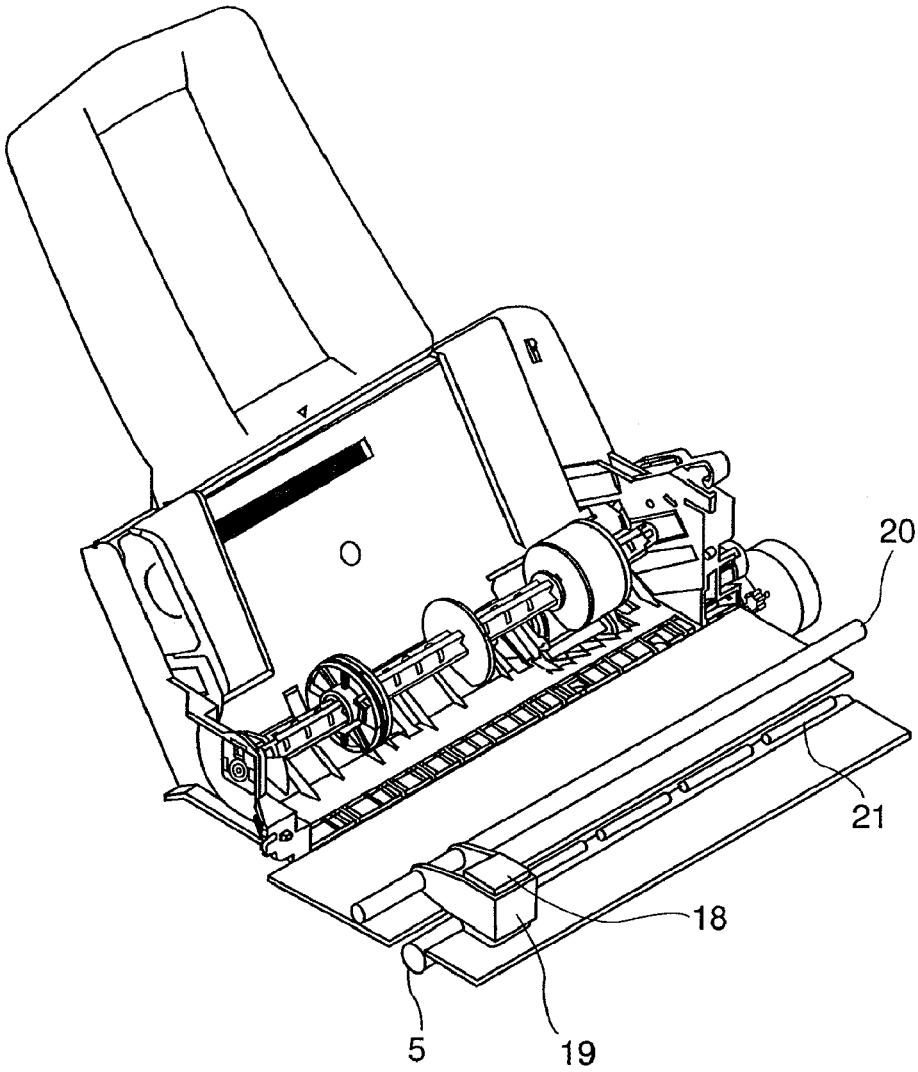
FIG. 7 is a perspective view of the entirety of an image forming apparatus.

FIG. 7 is a perspective view of the image forming apparatus fitted with the above described sheet feeding apparatus. In this drawing, reference numeral 18 stands for a recording head, and reference numeral 19 stands for a carriage on which the recording head is mounted. The carriage 19 is structured so that it is guided by a guiding shaft 20, and that as it is shuttled in the widthwise direction of a recording sheet by the force from an unshown mechanical power source. As the carriage 19 carrying the recording head 18 is shuttled, an image is formed on a recording sheet S by the recording head 18. Designated by reference numeral 5 is a conveying roller, which is rotationally supported by an unshown chassis, by its shaft, and which conveys a recording sheet S fed by the sheet feeding apparatus. Designated by reference numeral 21 is a pinch roller kept pressed on the conveying roller 5 by an unshown pressure generating means.

Next, referring to FIGS. 8-13, the operation for feeding and conveying a recording sheet S will be described.

Figure 8:
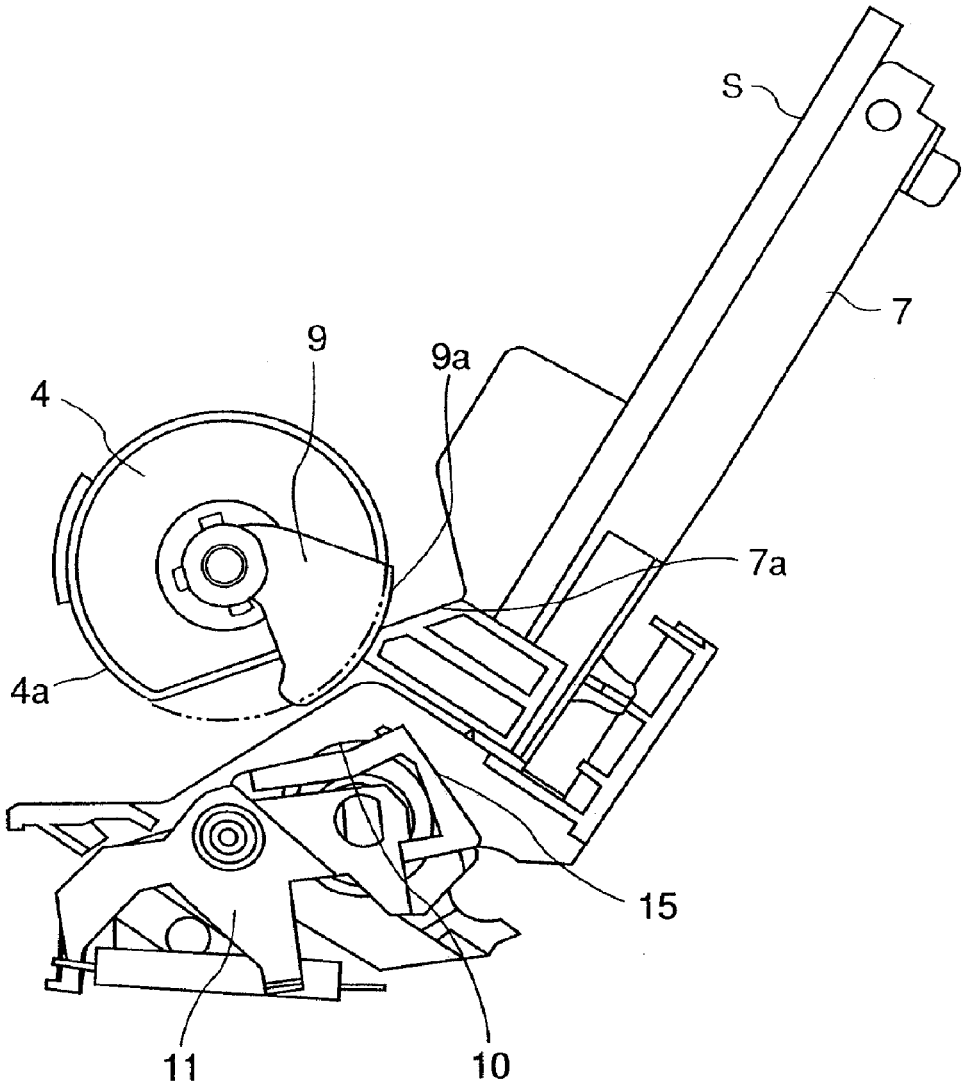
FIG. 8 is a schematic drawing for describing the operation of a sheet feeding apparatus.

Referring to FIG. 8, at the initial stage of the operation, the cam surface 9*a* of the pressure plate regulation cam 9 is in contact with the cam surface 7*a* of the pressure plate 7, creating a gap between the feed roller 4 and pressure plate 7. Also at this stage, the separation roller holder 11 is under the control from an unshown regulating means. Therefore, the separation roller 10 held by the separation roller holder 11, and the preregulating member 15, are on the outward side of the locus of the cylindrical portion 4*a* of the peripheral surface of the feed roller 4 (which hereinafter will be referred to as cylindrical surface portion 4*a*), in terms of the radius direction of the feed roller 4.

Figure 9:
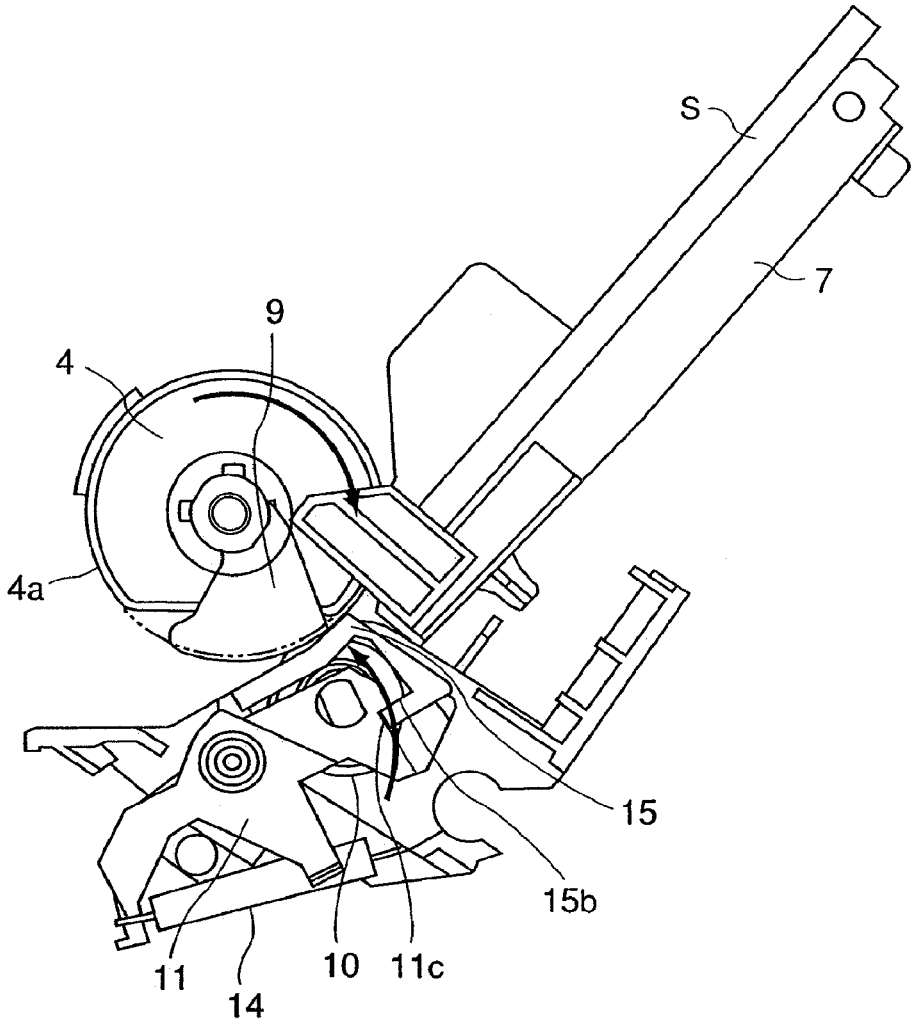
FIG. 9 is a schematic drawing for describing the operation of the sheet feeding apparatus.
Figure 10:
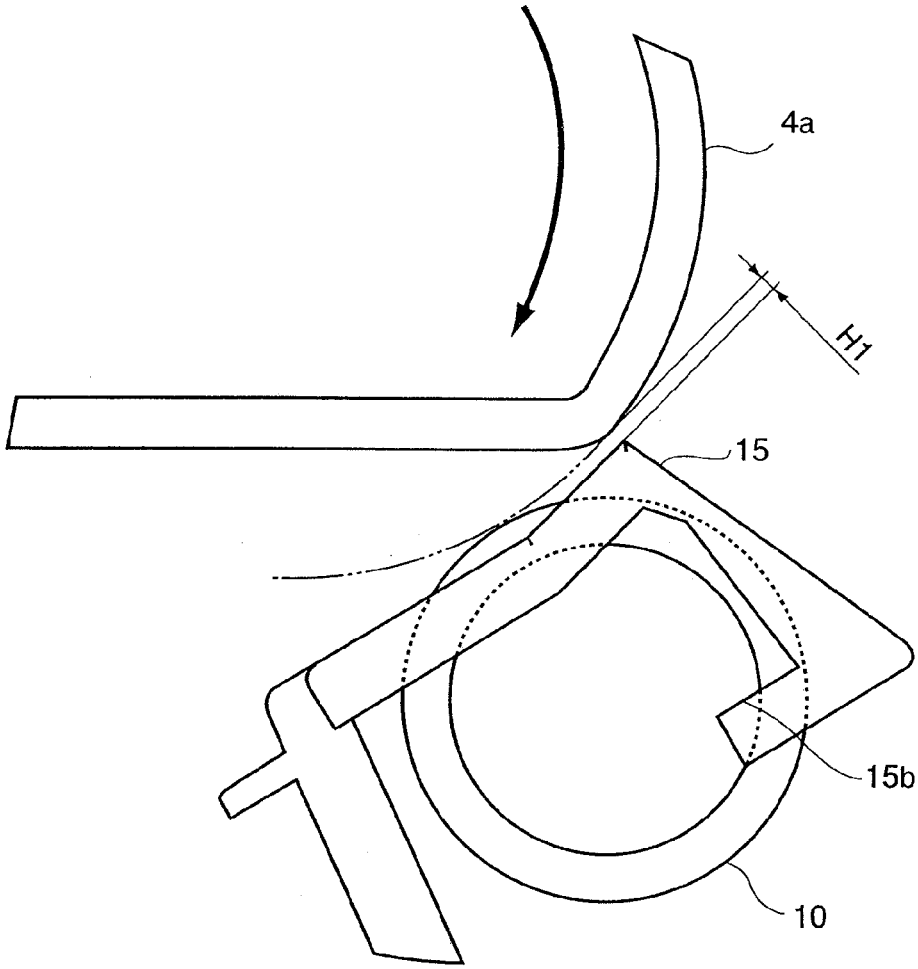
FIG. 10 is a schematic drawing for describing the operation of the sheet feeding apparatus.
Figure 11:
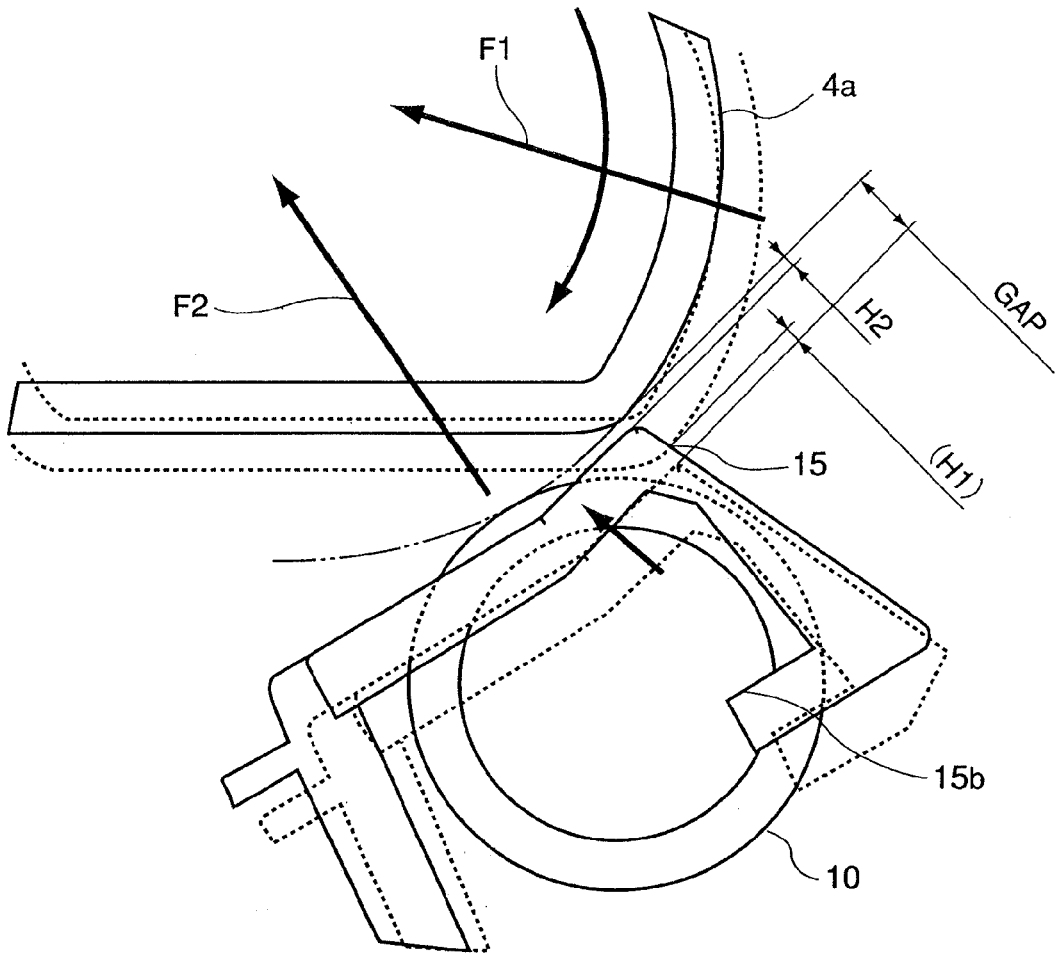
FIG. 11 is a schematic drawing for describing the operation of a sheet feeding apparatus.

As the sheet feeding apparatus receives a sheet feeding command, the mechanical power source 2 is driven. As a result, the feed roller 4 is rotated in the clockwise direction as shown in FIG. 9. At the same time, the control on the separation roller holder 11 by the regulating means is removed, allowing the separation roller holder 11 to pivoted about the shaft 11*a* by the separation roller pressuring means 14. As a result, the separation roller 10 comes into contact with the cylindrical surface portion 4*a* of the feed roller 4, creating a desired gap H1 between the cylindrical surface portion 4*a* and the preregulating member 15, as shown in FIG. 10, since the preregulating member 15 is kept pressured by the pressure generating means 17, and the bumper 15*b* is in contact with the regulating member 11*c*.

The cam surface 9*a* of the pressure plate regulation cam 9 and the cam surface 7*a* of the pressure plate 7 become separated from each other, and the pressure plate 7 comes under the pressure from a pressure plate spring 8. Further, the feed roller 4 comes into contact with a recording sheet S on the pressure plate 7, and the recording sheet S is picked up by the rotating feed roller 4. As described above, there is a desired gap H1 between the cylindrical surface portion 4*a* of the feed roller 4 and the preregulating member 15. Therefore, even if three or more recording sheets S are picked up by the feed roller 4, the preregulating member 15 makes it virtually impossible for three or more recording sheets S to be sent into the nipping portion between the feed roller 4 and separation roller 10 at the same time.

Also as described above, it is possible that the feed roller 4 will be deformed by the pressure F1 (approximately 300 gf-500 gf) from the pressure plate spring 8 and the pressure F2 (approximately 100 gf-300 gf) from the separation roller pressuring means 14. However, even if the feed roller 4 becomes deformed, the separation roller 10 is kept in contact with the cylindrical surface portion 4*a* of the feed roller 4, by the separation roller pressuring means 14. Further, since the preregulating member 15 attached to the separation roller holder 11 also moves, it is ensured that the gap H2 between the feed roller 4 and preregulating member 15 remains virtually the same as the aforementioned gap H1. In other words, even if the feed roller 4 becomes deformed, the gap H2 between the feed roller 4 and preregulating member 15 continue to have a desired value. Therefore, even if three or more recording sheets are picked up by the feed roller 4, the preregulating member 15 makes it impossible for the three or more recording sheets to be sent into the nipping portion between the feed roller 4 and separation roller 10 at the same time.

Figure 12:
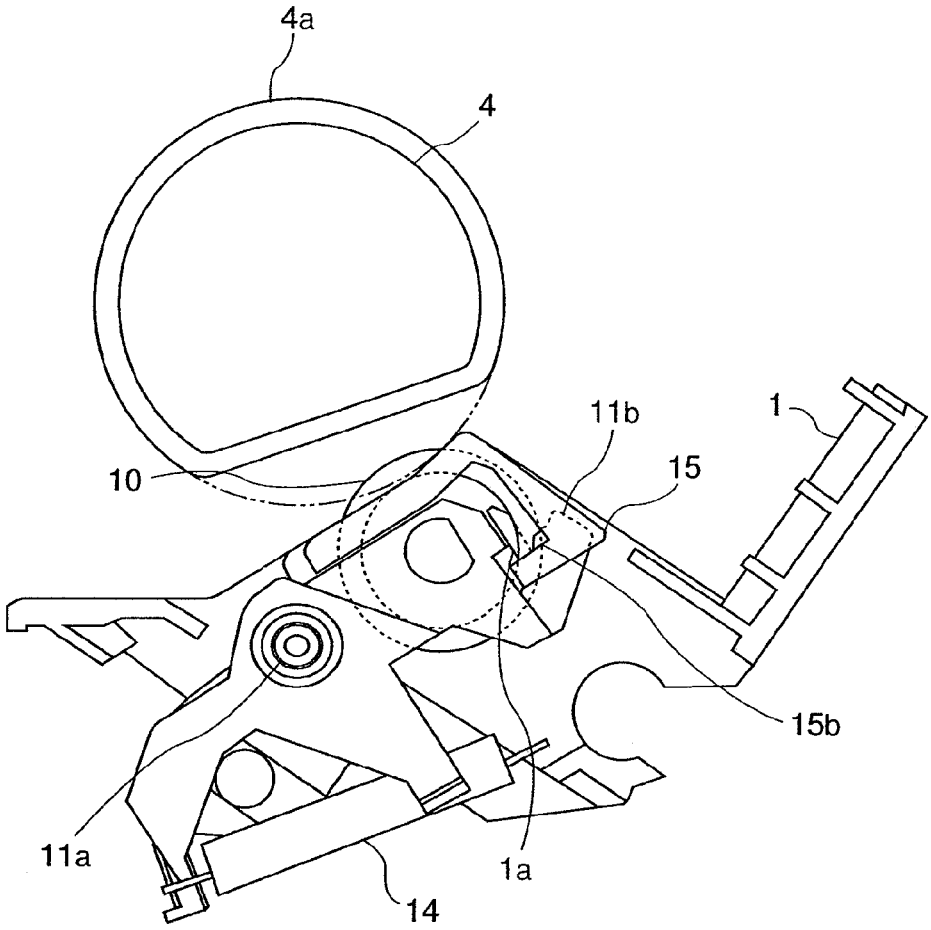
FIG. 12 is a schematic drawing for describing the operation of a sheet feeding apparatus.
Figure 13:
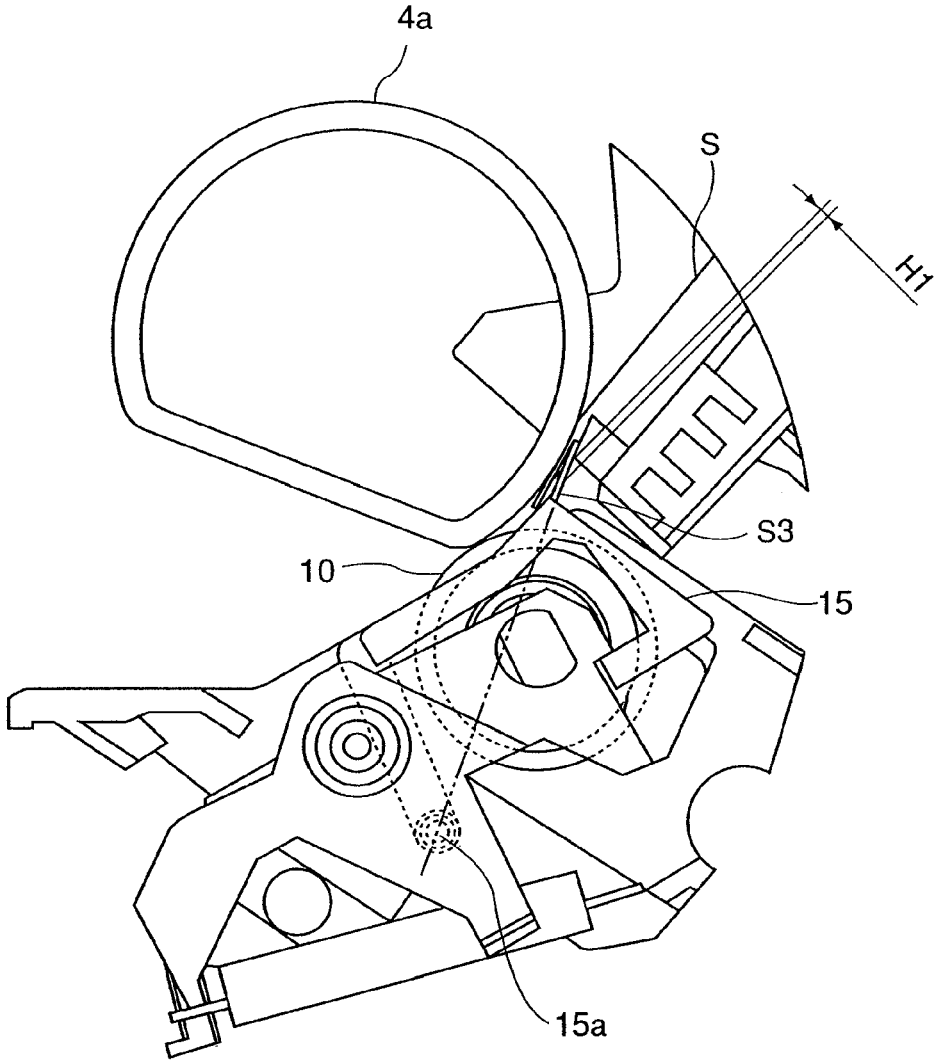
FIG. 13 is a schematic drawing for describing the operation of a sheet feeding apparatus.

The dimension of the pivotal range of the separation roller holder 11 is determined by the position of the point of contact between the bumper 11*b* of the separation roller holder 11 and the base member 1. Further, as described before, this sheet feeding apparatus is structured so that even if the feed roller 4 becomes deformed, the separation roller 10 remains in contact with the cylindrical surface portion 4*a* of the feed roller 4. Therefore, the preregulating member 15 must be capable of pivoting into the inward side of the circular locus of the cylindrical surface portion 4*a* of the feed roller 4 in terms of the radius direction of the feed roller 4. Thus, the apparatus is structured so that as the control from the unshown regulating means is removed at the beginning of the sheet feeding operation, the separation roller holder 11 is made to pivot about the shaft 11*a*, by the separation roller pressuring means 14, to the position (end of pivotal range) at which the bumper 11*b* of the separation roller holder 11 comes into contact with the base member 1, as shown in FIG. 12. With the bumper 11*b* of the separation roller holder 11 being in contact with the base member 1, the peripheral surface of the separation roller 10 is within the locus of the cylindrical surface portion 4*a* of the feed roller 4. However, the bumper 15*b* of the preregulating member 15 is under the control from the regulating member 1*a* of the base member 1. Therefore, the preregulating member 15 does not enter inward of the circular locus of the cylindrical surface portion 4*a* of the feed roller 4. Thus, it does not occur that the rubber portion of the feed roller 4 is shaved by the preregulating member 15, and/or that the preregulating member 15 becomes damaged due to the contact between the preregulating member 15 and feed roller 4.

It occurs sometimes that a recording sheet S becomes dislodged through the gap between the cylindrical surface portion 4*a* of the feed roller 4 and preregulating member 15, and the leading edge of the dislodged recording sheet S comes into contact with the preregulating member 15, pushing the preregulating member 15 in the recording sheet conveyance direction. It also occurs sometimes that the leading ends of the third recording sheet and the recording sheets thereafter picked up by the feed roller 4 come into contact with the preregulating member 15 and push the preregulating member 15 in the recording sheet conveyance direction. However, the axis of the shaft 15*a*, about which the preregulating member 15 pivots, approximately coincides with the theoretical extension of the recording sheet conveyance path, as shown FIG. 13. Therefore, the above described force applied to the preregulating member 15 by the recording sheet or sheets does not generate such moment that rotates the preregulating member 15 about the pivotal axis 15*a*. Thus, the gap H1 between the feed roller 4 and preregulating member 15 remains the same, being desirable.

As only a single recording sheet, or recording sheet S1, is sent into the nipping portion between the feed roller 4 and separation roller 10, the torque applied to the separation roller 10 by the feed roller 4 through the recording sheet S1 exceeds the predetermined value of the braking torque T1 of the torque limiter, causing the separation roller 10 to rotate. As a result, the recording sheet S1 is allowed to advance. On the other hand, as two recording sheets, or recording sheets S1 and S2, are sent into the nipping portion between the feed roller 4 and separation roller 10, the recording sheet S slides on the recording sheets S2. Therefore, the amount of the torque applied to the separation roller 10 by the feed roller 4 through the recording sheets S1 and S2 is smaller than the braking torque T1 of the torque limiter, failing to rotate the separation roller 10. As a result, only the recording sheet S1, which is in contact with the feed roller 4, is conveyed by the feed roller 4, while the recording sheet S2, which is in contact with the separation roller 10, is prevented from advancing, by the separation roller 10.

Thereafter, the pressure plate 7 separates from the feed roller 4, and then, the separation roller 10 separates from the feed roller 4. Next, the feed roller 4 stops rotating after rotating 360 degrees from the beginning of its rotation; in other words, the sheet feeding apparatus returns to its initial state.

After the conveyance of a recording sheet S into the main assembly of the image forming apparatus, an image is formed on the recording sheet S as a process in which the recording sheet S is conveyed a predetermined distance in the recording sheet conveyance direction, and a process in which the carrier 19 is moved in the direction perpendicular to the recording sheet conveyance direction while the recording head 18 is driven, are alternately repeated. As a result, an image is formed on the recording sheet S.

As described above, this embodiment of a sheet feeding apparatus is structured so that the preregulating member 15 is allowed to pivotally move relative to the separation roller holder 11, and is provided with the regulating member 1*a* for regulating the movement of the preregulating member 15. Therefore, even if the feed roller 4 becomes deformed, the gap between the feed roller 4 and preregulating member 15 remains constant. Further, the preregulating member 15 does not enter inward of the circular locus of the cylindrical surface portion 4*a* of the feed roller 4, and therefore, the preregulating member 15 does not come into contact with the feed roller 4. Further, the pivotal axis 15*a* of the preregulating member 15 approximately coincides with the theoretical extension of the recording sheet conveyance path. Therefore, the preregulating member 15 is not subjected to such moment that acts in the direction to pivot the preregulating member 15 about the axis 15*a*. Therefore, the gap between the feed roller 4 and preregulating member 15 remains constant.

This embodiment of a sheet feeding apparatus in accordance with the present invention is a demonstration of a structure which employs a separation roller as a sheet separating means. However, effects similar to the above-described ones can be obtained even if a frictional member is employed as a sheet separating means.

Not only is the above-described sheet feeding apparatus usable for image formation, but also is usable as a preferable sheet feeding apparatus for an image reading apparatus capable of consecutively reading two or more originals.

As described above, according to the present invention, it is possible to provide a sheet feeding apparatus and a recording apparatus, in which the gap between the feed roller and preregulating member remains constant, and which is stable in its sheet feeding performance.

Embodiment 2

Figure 14:
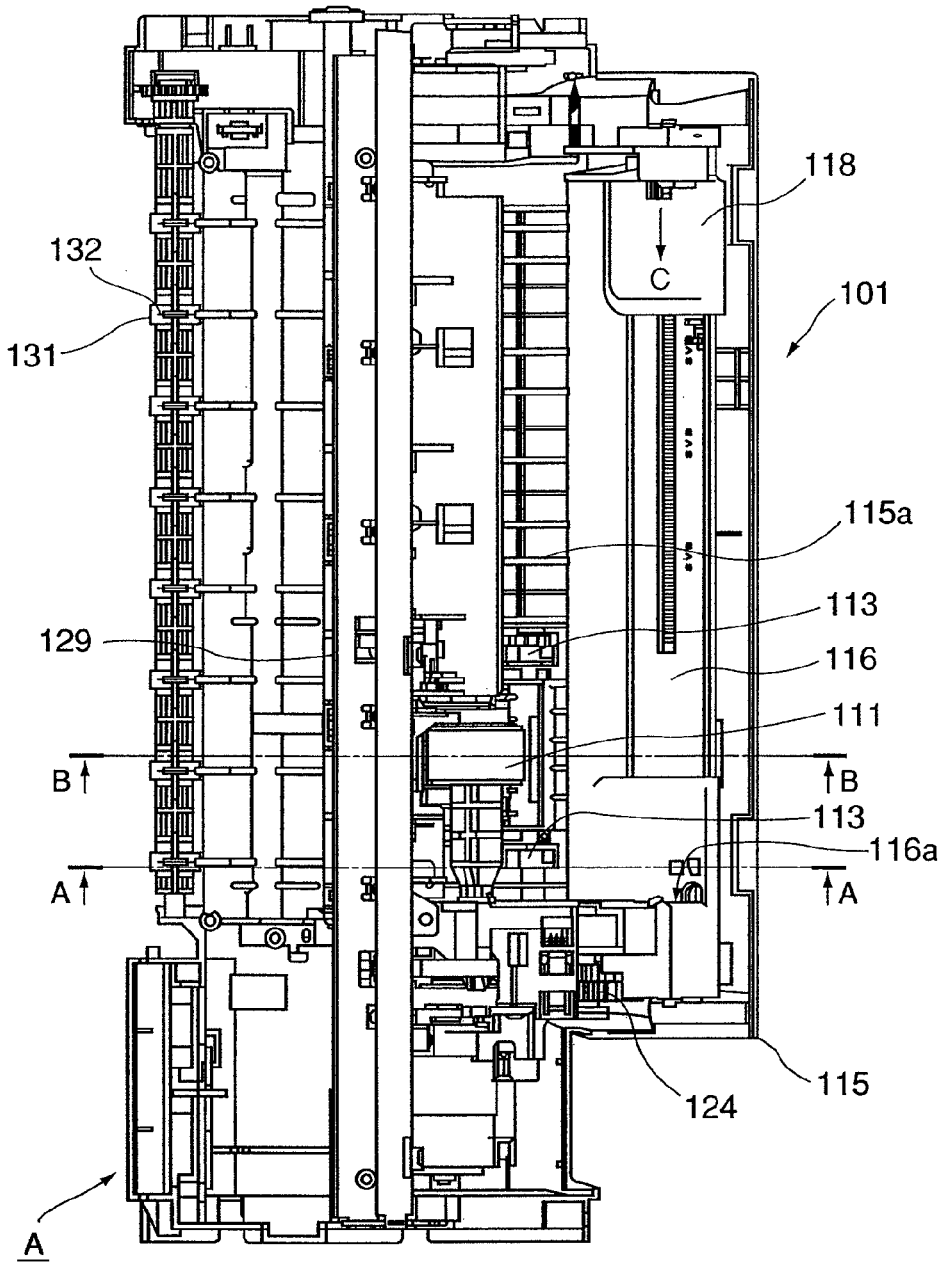
FIG. 14 is a top plan view of the entirety of a recording apparatus equipped with the first embodiment of a sheet feeding apparatus in accordance with the present invention.
Figure 15:
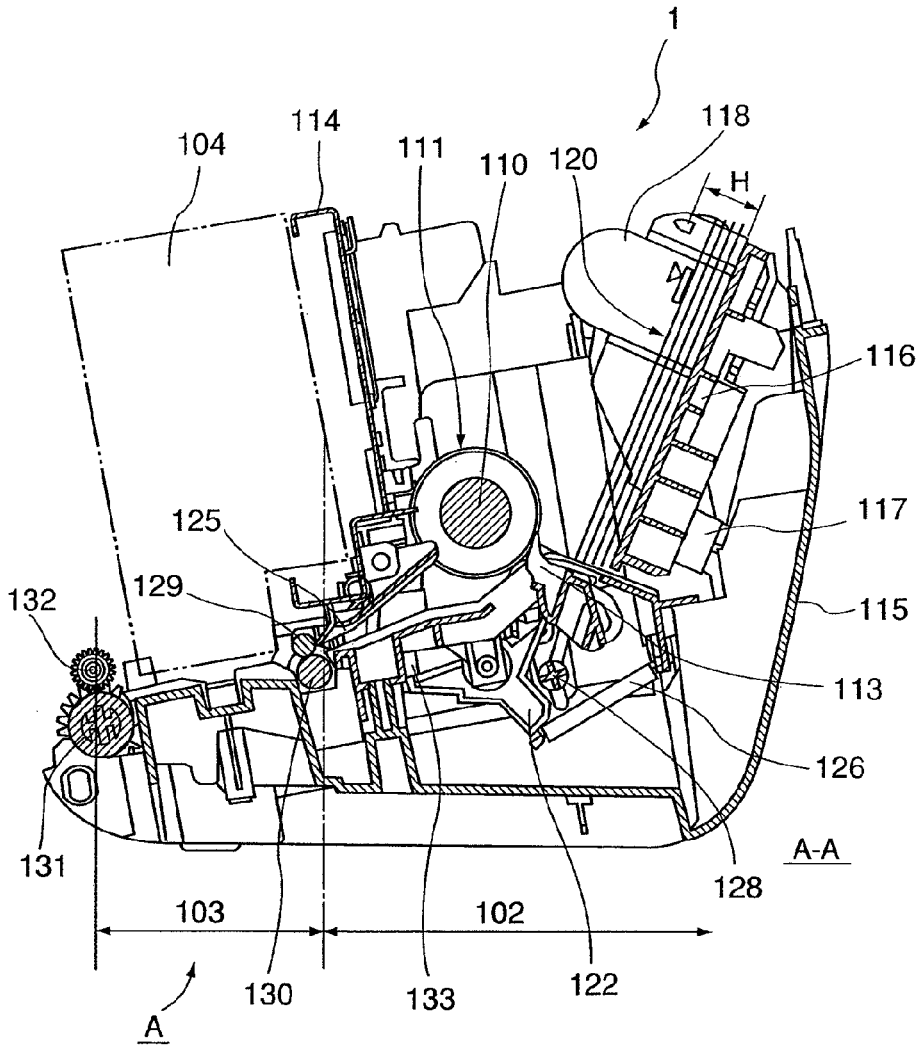
FIG. 15 is a sectional view of a recording apparatus equipped with a sheet feeding apparatus.
Figure 16:
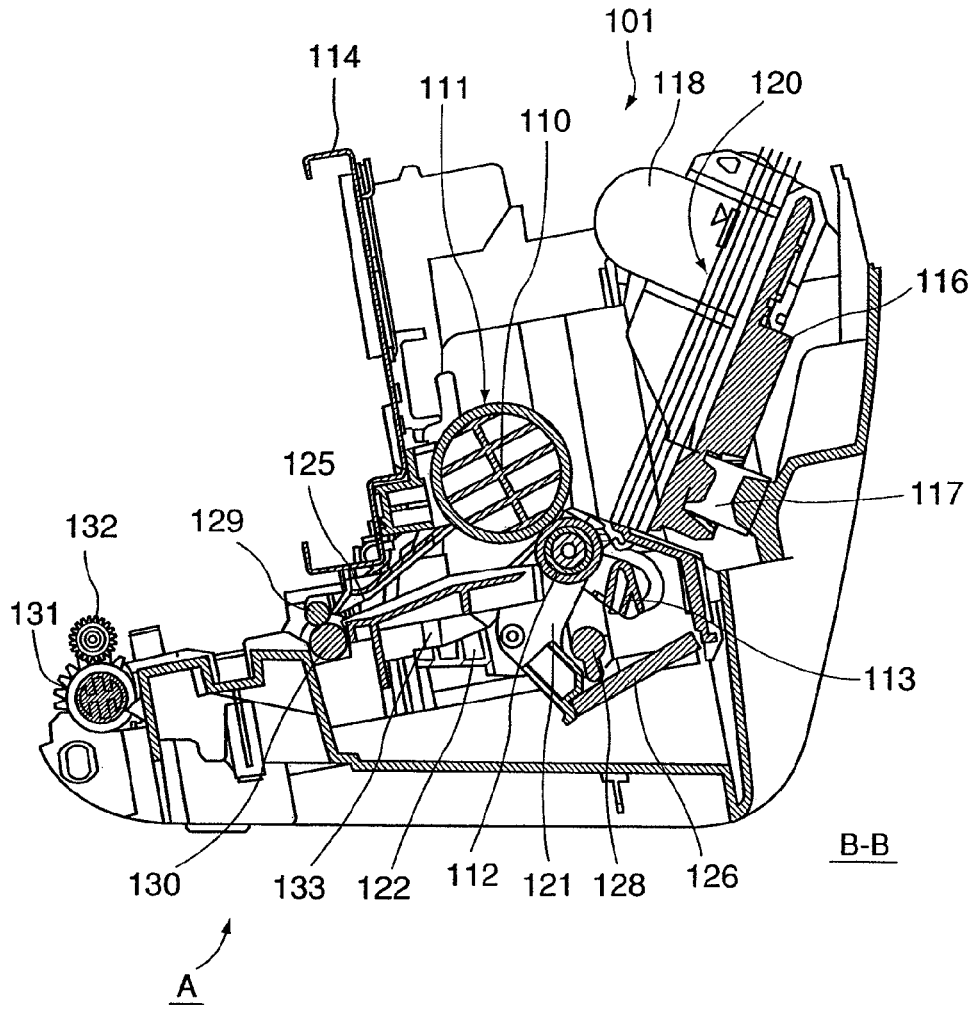
FIG. 16 is a sectional view of a recording apparatus equipped with a sheet feeding apparatus.

Next, the second embodiment of a sheet feeding apparatus in accordance with the present invention will be described with reference to the appended drawings. FIG. 14 is a plan view of the front of a recording apparatus equipped with a sheet feeding apparatus in accordance with the present invention. FIG. 15 is a sectional view of the recording apparatus in FIG. 14, at plane A-A in FIG. 14. FIG. 16 is a sectional view of the recording apparatus in FIG. 14, at plane B-B in FIG. 14.

The recording apparatus A comprises: a sheet feeding apparatus 101, a recording station 103, a sheet discharging roller 131, and a spur-shape wheel 132. After being fed into the recording apparatus A by the sheet feeding apparatus 101, a recording sheet is nipped between the pinch roller 129 kept pressed on a conveying roller 130 by a pinch roller holder 125, and the conveying roller 130. Then, it is conveyed to the recording station 103 while remaining nipped. Then, the recording sheet is conveyed through the recording station. While the recording sheet is conveyed through the recording station 103, ink is ejected onto the surface of the recording sheet from the nozzles (unshown) of a recording head 104, recording an image on the surface of the recording sheet. After the formation of an image on the recording sheet in the recording station 103, the recording sheet is discharged from the recording apparatus A by a discharging means comprising the discharge roller 131 and spur-shaped wheel 132.

The sheet feeding apparatus 101 comprises a sheet holding portion, a feeding/separating portion 102, and a portion for preventing sheets from being fed by two or more at the same time. The sheet feeding apparatus 101 was designed on the assumption that it would be used as an integral part of a recording apparatus, or the like. Thus, it does not have, in itself, a mechanical power source for driving. Therefore, it is driven by the driving force transmitted thereto from, for example, a recording apparatus (which hereinafter will be referred to as main assembly); in other words, it is an apparatus which is driven by another apparatus.

The sheet holding portion comprises a base 115, a pressure plate 116, and a side guide 118. A recording sheet is placed in the sheet holding portion, slightly slanted relative to the horizontal direction of the recording apparatus. Therefore, as it is placed in the sheet holding portion, it leading edge, that is, the bottom edge, strikes the sheet alignment reference portion 115*a* solidly attached to the base 115. The sheet edge alignment reference portion 115*a* is made up of a plurality of parallel ribs, minimizing the force necessary to move a recording sheet.

The pressure plate 116 is a plate for pushing a recording sheet toward the feed roller 111, and is under the pressure generated by the pressure plate spring 117 in the direction to pivot the pressure plate 116 toward the feed roller 111. As the unshown cam of the control gear 124 presses the pressure plate 116, the pressure plate 116 is forced to pivot in the direction to move away from the feed roller 111. In other words, as the control gear 124 rotates, the pressure plate 116 repeats an operational cycle of pressing a recording sheet and moving away from the recording sheet. As a result, the recording sheets are moved toward the feed roller 111.

In this embodiment, the angle of the sheet holding surface of the sheet holding portion, relative to the horizontal direction of the recording apparatus, is approximately 70 degrees, contributing to the reduction of the overall size of the recording apparatus, that is, the size of the recording apparatus inclusive of the recording sheets 120 held slanted in the sheet holding portion.

While the sheet feeding apparatus 101 is not conveying a recording sheet, that is, while the sheet feeding apparatus 101 is on standby, the pressure plate 116 is kept at a predetermined location toward which the pressure plate 116 is moved away from the feed roller 111. The sheet feeding apparatus 101 is structured so that when the pressure plate 116 is at this predetermined location, a gap large enough to hold a plurality of recording sheets is present between the feed roller 111 and pressure plate 116. The pressure plate 116 has a sheet conveyance reference portion 116*a*, which projects from a predetermined point of the pressure plate 116, and which constitutes a referential member for keeping a recording sheet accurately positioned in terms of the widthwise direction of the recording apparatus.

The side plate 118 is slidably attached to the pressure plate 116, and latches with the set of grooves cut in the recording sheet holding surface of the pressure plate 116 in a manner of forming a rack, being prevented from accidentally moving. Thus, in order to move the side guide 118, the lever of the side guide 118 must be operated to unlatch the side guide 118 from the pressure plate 116.

When loading the recording apparatus with recording sheets, they are to be placed into the gap between the feed roller 111 and pressure plate 116, along the sheet conveyance reference portion 116*a*. After the loading of the recording sheets, the side guide 118 is to be moved in the direction indicated by an arrow mark C in FIG. 14 while pushing the recording sheets by their edges on the side opposite to the sheet conveyance reference portion 116*a* with respect to the recording sheets. As a result, the gap between the sheet conveyance reference portion 116*a* and side guide 118 becomes equal to the width of a recording sheet, preventing the recording sheets held in the recording sheet holding portion from moving in the direction (widthwise direction of recording sheet) perpendicular to the recording sheet conveyance direction. In other words, with the provision of this structural arrangement, the gap between the sheet conveyance reference portion 116*a* and side guide 118 can be optionally set, making it possible to reliably convey recording sheets regardless of their widths.

Next, the structure of the feeding/separating portion 102 will be described. The recording sheets 120 in the recording sheet holding portion are pressed against the feed roller 111 by the above described movement of the pressure plate 116. The feed roller 111 begins to be rotationally driven as soon as the recording sheets 120 are pressed against the feed roller 111. As a result, the top recording sheet, or the recording sheet in contact with the feed roller 111 is advanced due to the presence of friction between the top recording sheet and feed roller 111. Since the recording sheet is conveyed due to the presence of friction between the feed roller 111 and recording sheet, it is recommended that the feed roller 111 is formed of rubber, foamed urethane, or the like, which is relatively large in coefficient of friction; for example, EPDM.

In most cases, the friction between the feed roller 111 and the top recording sheet is greater than that between the top recording sheet and the record sheet immediately thereunder. Usually, therefore, only the top recording sheet is advanced. However, there are times when two or more recording sheets are pulled out of the recording sheet holding portion. This phenomenon occurs, for example, when two or more recording sheets, the edges of which have been burred while they were cut, are pressed against the feed roller 111, when two or more recording sheets adhering to each other due to the presence of static electricity are pressed against the feed roller 111, or when two or more recording sheets which are very large in coefficient of friction, are pressed against the feed roller 111.

In such a case, the topmost recording sheet is separated from the rest by the separation roller 112, a sheet separating means, equipped with a torque limiter. The separation roller 112 is kept pressed on the feed roller 111 so that it contacts the feed roller 111, on the downstream side with respect to the point at which a recording sheet comes into contact with the feed roller 111 for the first time, in terms of the recording sheet conveyance direction.

Figure 17:
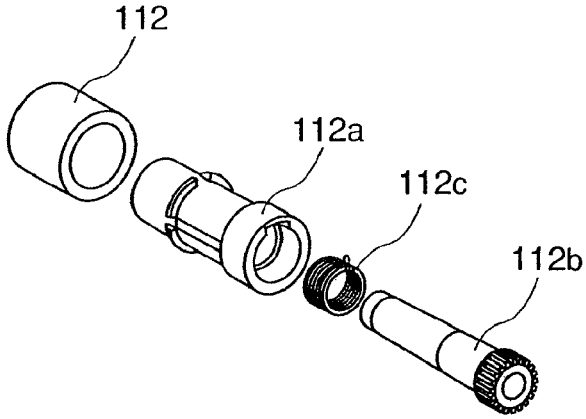
FIG. 17 is a perspective view of the disassembled separation roller, for showing the structure thereof.

Herein, referring to FIGS. 17 and 18, the structure of the separation roller 112 will be described. The separation roller 112 is fixed to a clutch cylinder 112*a*, in which a clutch shaft 112*b* is rotatably held, with a clutch spring 112*c* tightly wound around the clutch shaft 112*b*. The one end of the clutch spring 112*c* is anchored to the clutch cylinder 112*a*.

With the provision of the above described structural arrangement, as the separation roller 112 and clutch cylinder

Figure 18:
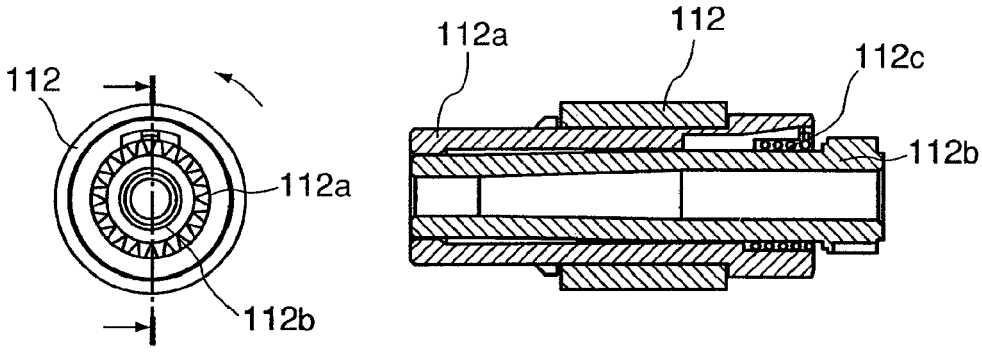
FIG. 18 is a sectional view of the separation roller.

112*a* are rotated in the direction indicated by an arrow mark in FIG. 18, without allowing the clutch shaft 112*b* to rotate, the clutch spring 112*c* fitted around the clutch shaft 112*b* is unwound in the direction to be loosened from the clutch shaft 112*b*. Thus, as the separation roller 112 and clutch cylinder 112*a* are rotated a certain angle (predetermined angle), the clutch spring 112*c* loses its grip on the clutch shaft 112*b*, and rotates around the clutch shaft 112*b*. In other words, the above described structural arrangement provides a predetermined amount of braking torque.

In order to provide the separation roller 112 with a coefficient of friction approximately equal to that of the feed roller 111, the surface layer of the separation roller 112 is formed of rubber, foamed urethane, or the like. The separation roller 112 is rotatably supported by a separation roller holder 121, that is, a sheet separating means holding member, with the interposition of clutch cylinder 112*a* and clutch shaft 112*b*. It is kept pressed on the feed roller 111 by a separation roller spring 126.

With the provision of the above described structural arrangement, when there is no recording sheet between the feed roller 111 and separation roller 112, the separation roller 112 is rotated by the rotation of the feed roller 111.

The friction between the feed roller 111 and the recording sheet, and the friction between the recording sheet and separation roller 112, are greater than the braking torque of the torque limiter of the separation roller 112. Therefore, as a single recording sheet enters between the feed roller 111 and separation roller 112, the recording sheet is advanced by the feed roller 111 while rotating the separation roller 112. However, as two recording sheets enter between the feed roller 111 and separation roller 112, the friction between the feed roller 111 and the recording sheet next to the feed roller 111 is greater than the friction between the two recording sheets, and the friction between the recording sheet next to the separation roller 112 is greater than the friction between the two recording sheets. Therefore, as the feed roller 111 is rotated, the recording sheet next to the feed roller 111 slides on the recording sheet next to the separation roller 112. As a result, only the recording sheet next to the feed roller 111 is advanced by the feed roller 111, while the recording sheet next to the separation roller 112 remains with the separation roller 112, which remains stationary.

Next, the structure of the portion for preventing two or more recording sheets from being fed into the recording apparatus all at once will be described. As described above, when two recording sheets enter between the feed roller 111 and separation roller 112, they can be separated. However, sometimes, three or more recording sheets enter between the feed roller 111 and separation roller 112, or one or more recording sheets enter between the feed roller 111 and separation roller 112 while the bottom recording sheet, that is, the recording sheet next to the separation roller 112, of the two recording sheets having entered between the feed roller 111 and separation roller T T2 during the preceding rotation of the feed roller 111 is still in the adjacencies of the nipping portion between the feed roller 111 and 112 after the first recording sheet, that is, the recording sheet next to the feed roller 11T, has been successfully fed. In these cases, it is possible that two or more recording sheets are fed into the recording apparatus all at once. In order to prevent this accident, the sheet feeding apparatus is provided with a portion that prevents the simultaneous feeding of two or more recording sheets into the main assembly has a sheet returning lever 113, which prevents the leading edge of a recording sheet from accidentally entering beyond a predetermined point in a sheet feeding apparatus, by being moved into the recording sheet path while recording sheets are placed in the recording sheet holding portion, or while the recording apparatus is on standby.

The sheet returning lever 113 is pulled out of the sheet conveyance path immediately after the beginning of a sheet feeding operation, and is kept out of the sheet conveyance path during the sheet feeding operation. Thus, the sheet returning lever 13 does not interfere with the advance of a recording sheet.

As soon as a sheet separating operation ends, the sheet returning lever 13 is made to begin to return the recording sheets in the separation nip, by the function of the unshown cam of the control gear 124. Before, the sheet returning lever 13 begins to operate, the preregulating member holder 122 holding the preregulating member 122*a*, and the separation roller holder 121 holding the separation roller 112, are moved by a release cam 123 in the direction to move away from the feed roller 111. With the provision of wider gaps between the preregulating member holder 22 and feed roller 111, and between the separation roller holder 121 and feed roller 111, it requires a smaller amount of force to return the recording sheets by the sheet returning lever 13 than otherwise.

After returning the recording sheets, the sheet returning lever 13 is rotated out of the sheet conveyance path. Then, it is moved to the standby position after it is confirmed that the trailing end of the recording sheet has passed the sheet feeding apparatus 101.

Figure 19:
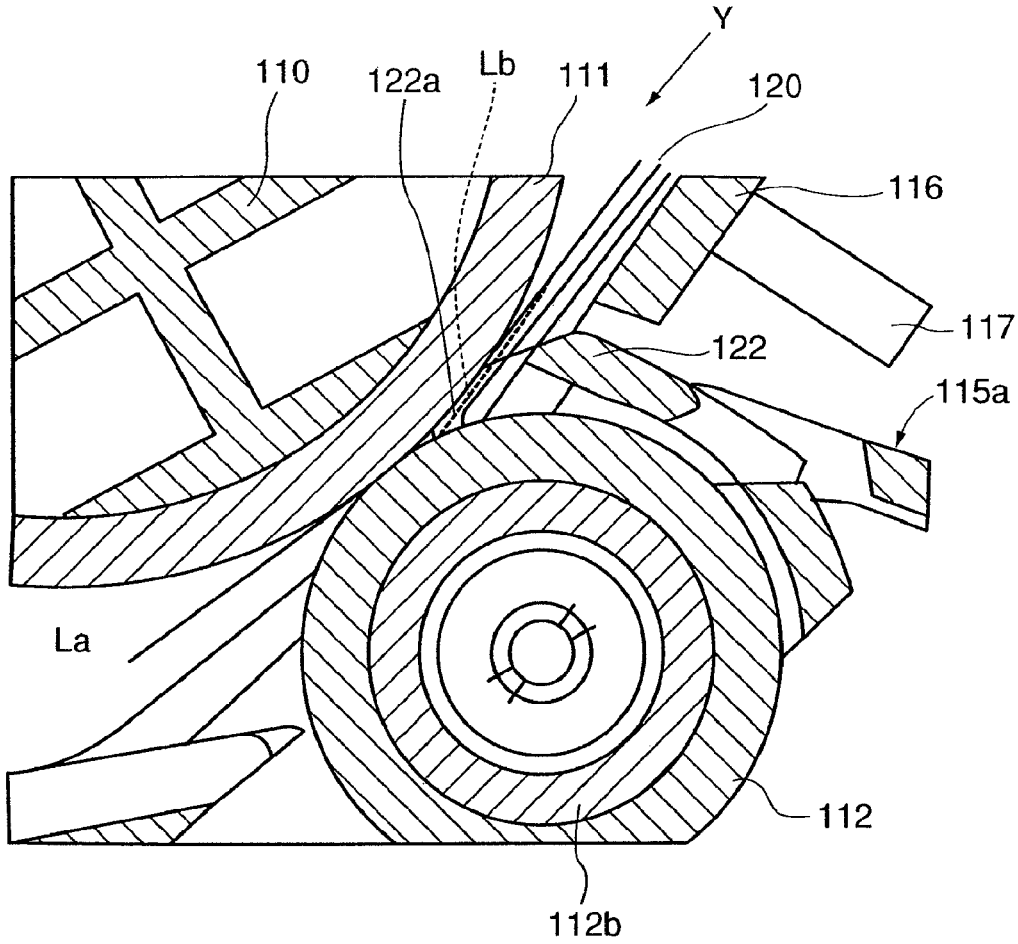
FIG. 19 is a schematic sectional view of the sheet separating portion.
Figure 20:
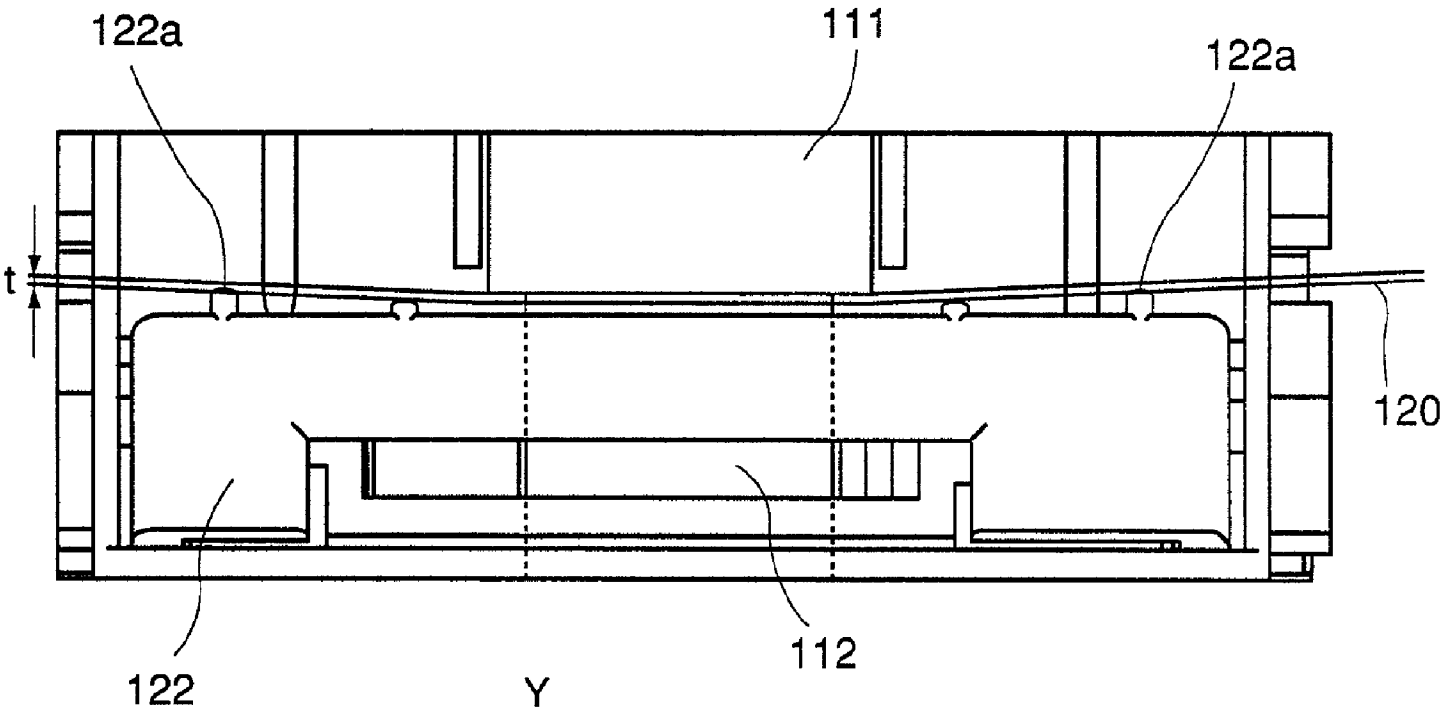
FIG. 20 is a plan view of the sheet separating portion, as seen from the direction from which recording sheets are conveyed.

Next, the path through which a recording sheet reaches the sheet separating portion will be described. FIG. 19 is a schematic sectional view of the sheet separating portion, and FIG. 20 is a plan view of the sheet separating portion, as seen from the direction from which the recording sheet is conveyed into the sheet separation portion.

Referring to FIG. 19, as a recording sheet 120 is placed in the recording sheet holding portion, the recording sheet 120 is pressed toward the feed roller 111 by the pressure plate 116 which is under the pressure from the pressure plate spring 117. Therefore, first, the leading edge, or the bottom edge, of the recording sheet 120 is moved past the sheet edge alignment reference portion 115*a*, and reaches recording sheet attitude control ribs 122*a*, which are recording sheet attitude controlling members of the preregulating member 122. The edge portion of each attitude control rib 122*a*, on the sheet entrance side, is slanted, making it easier for the attitude control rib 122*a* to guide the leading edge of the recording sheet into the sheet separating portion. As seen from the direction perpendicular to FIG. 19, the peripheral surface of the feed roller 111 is level with the top of the attitude control rib 122*a*, and therefore, it looks as if a recording sheet conveyance path L were closed. However, in terms of the widthwise direction of the recording sheet 120, the feed roller 111 is apart from the attitude control ribs 122*a*, as shown in FIG. 20. Therefore, while the recording sheet 120 is conveyed through the sheet separating portion, it remains slightly bowed, more specifically, by a distance t equal to the thickness of the recording sheet, toward the separation roller 112.

While the recording sheet 120 is advanced, remaining in the above described condition, by the feed roller 11T, the leading edge of the recording sheet 120 reaches the cylindrical surface of the separation roller 112. More specifically, at that moment, the points of the leading edge of the recording sheet, at which the recording sheet 120 is supported from below by the attitude control ribs 122*a*, come into contact with the cylindrical surface of the separation roller 112, entering the recording sheet conveyance path La indicated by a solid line in FIG. 19, from the downstream side with respect to the attitude ribs 122*a*. On the other hand, the portions of the leading edge of the recording sheet 120, under which no attitude control ribs 122*a* are present, in particular, across the portion corresponding to the center portion of the feed roller 11T, where the curvature of the recording sheet 120 is largest, come into contact with the cylindrical surface of the separation roller T T2, following the recording sheet conveyance path Lb represented by a broken line in FIG. 19.

In other words, there is a certain amount of difference between the angle of the recording sheet relative to the cylindrical surface of the separation roller 112, in the range, in terms of the widthwise direction of the recording sheet, in which no attitude control ribs 122*a* are resent under the recording sheet, and the angle of the recording sheet relative to the cylindrical surface of the separation roller 112, in the range, in terms of the widthwise direction of the recording sheet, in which the attitude control ribs 122*a* are present under the recording sheet. However, the attitude control ribs 122*a* are always in contact with the bottom surface of the recording sheet. Therefore, they are able to keep more or less constant the angle the recording sheet 120 relative to the separation roller 112, even across the range in which no attitude control ribs 122*a* are present.

In this embodiment, the external diameters of the feed roller 111 and separation roller 112 are approximately 30 mm and 14 mm, which are relatively small. Even when they are this small, it is possible to ensure that the leading edge of the recording sheet 120 comes into contact with the cylindrical peripheral surface of the separation roller 112, at approximately 30° relative to the line tangential to the peripheral surface of the separation roller 112 at the contact point between the recording sheet and the peripheral surface of the separation roller 112. In other words, with the provision of the above-described structural arrangement, it is possible to reduce the angle at which the leading edge portion of the recording sheet 120 comes into contact with the cylindrical peripheral surface of the separation roller 112, in order to prevent the recording sheet 120 from failing to be advanced.

It has been known through experiments that when the angle, which the recording sheet 120 forms relative to the line tangential to the cylindrical peripheral surface of the separation roller 112 at the contact point between the leading edge of the recording sheet 120 and the cylindrical peripheral surface of the separation roller 112 as the leading edge comes into contact with the cylindrical peripheral surface of the separation roller 112, is greater than 45°, the recording sheet is likely to fail to be advanced. In view of this knowledge, it is evident that it is unlikely that in a sheet feeding apparatus in accordance with the present invention, the recording sheet fails to be advanced.

Incidentally, the attitude control ribs 122*a* may be rendered tall enough for their tips to be inside of the contour of the feed roller 111 as the sheet separating portion is seen from the axial direction of the feed roller 111, although the heights of the attitude control ribs 122*a* in this embodiment are such that their tips are level with the peripheral surface of the feed roller 111 as the sheet separating portion is seen from the axial direction of the feed roller 111.

Further, the attitude control ribs 122*a* are formed so that the farther from the separation roller 112 in terms of the widthwise direction of the recording sheet, the attitude control ribs 122*a*, the taller they are. With the provision of this structural arrangement, the angle between the recording sheet 120 and separation roller 112, in the range in which no attitude control ribs 122*a* are present, can be more reliably controlled.

Further, the attitude controlling members may be wider than those in this embodiment, in terms of the widthwise direction of a recording sheet 120. The effects of such a modification will be virtually the same as those of the attitude controlling members in this embodiment.

Further, in this embodiment, the separation roller 112 equipped with a torque limiter was employed as a recording sheet separating means. However, the present invention is also applicable to a friction pad type sheet feeding apparatus employing a frictional member as a sheet separating means, and the application will be very satisfactory.

Embodiment 3

Figure 21:
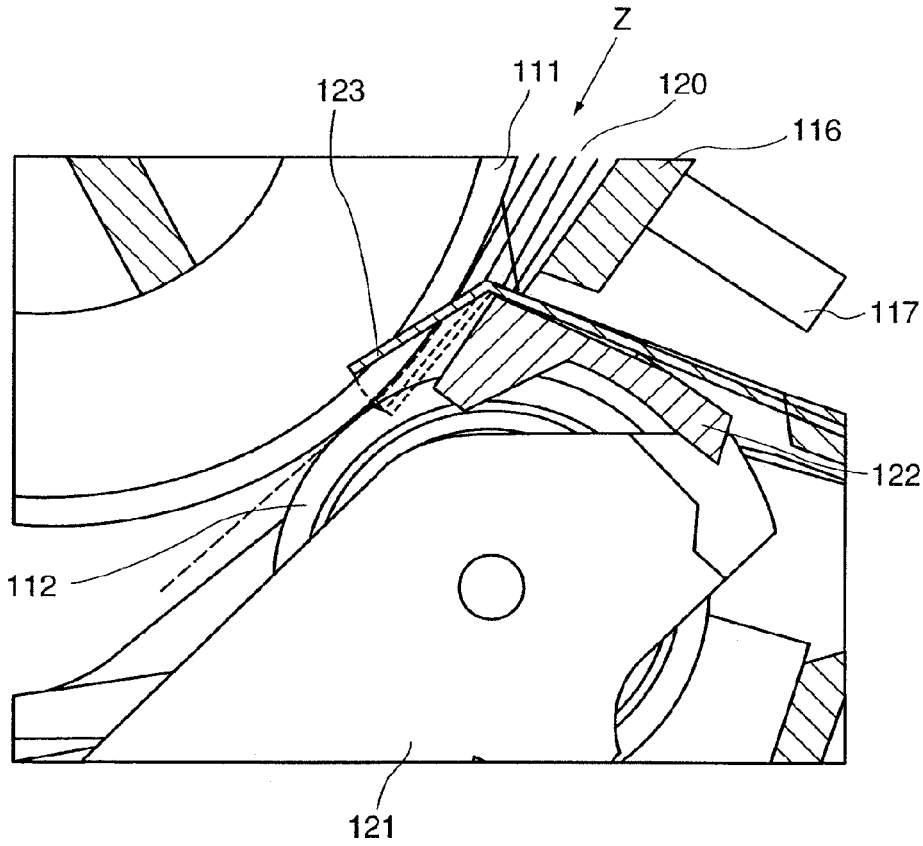
FIG. 21 is a schematic sectional view of the sheet separating portion of the second embodiment of a sheet feeding apparatus in accordance with the present invention.
Figure 22:
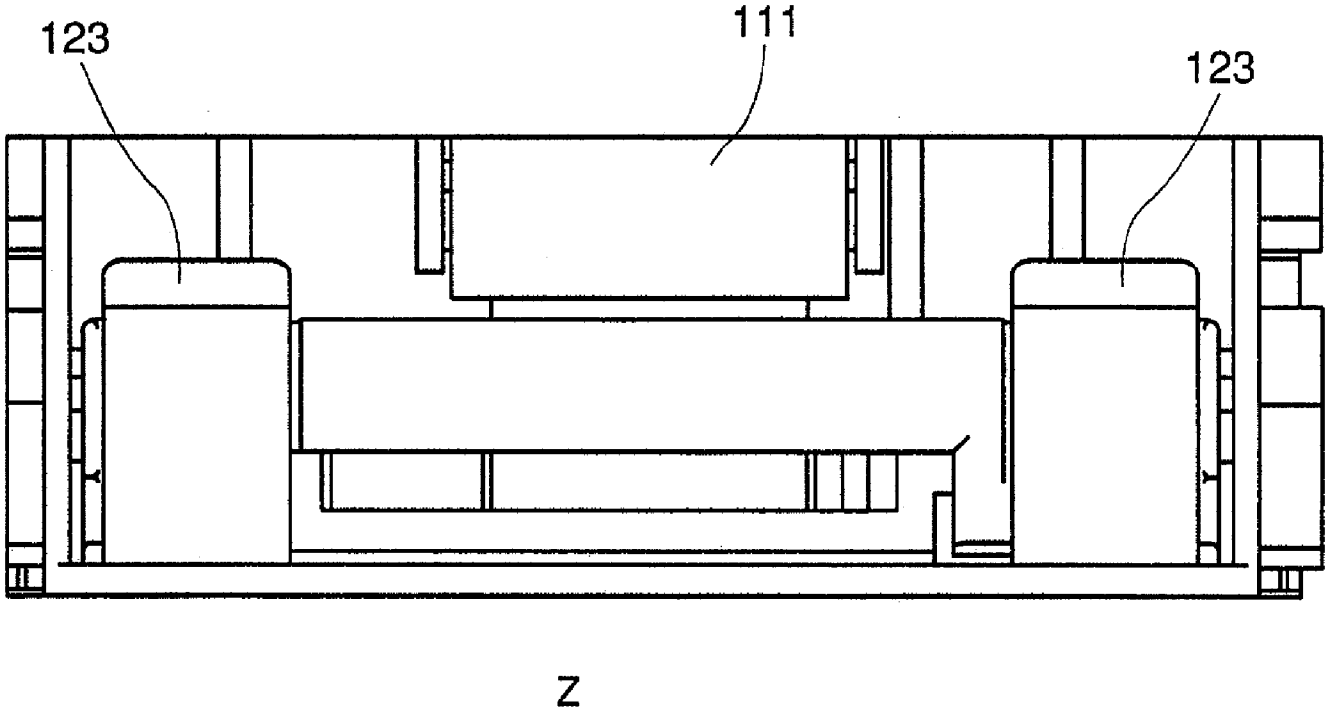
FIG. 22 is a plan view of the sheet separating portion, as seen from the direction from which recording sheets are conveyed.

Next, the third embodiment of a sheet feeding apparatus in accordance with the present invention will be described. FIG. 21 is a schematic sectional view of the sheet separating portion this embodiment of a sheet separating apparatus in accordance with the present invention, and FIG. 22 is a plan view of the sheet separating portion in FIG. 21, as seen from upstream of the apparatus in terms of the sheet conveyance direction. The components in this embodiment of a sheet feeding apparatus similar in description to those in the above described second embodiment are given the same referential signs as those in the second embodiment, and their descriptions will be not be given here.

This embodiment is similar to the second embodiment except that this embodiment has an elastic and easily flexible sheet attitude control plate 123 instead of the sheet attitude control ribs 122*a* in the second embodiment.

Until a recording sheet 120 reaches the preregulating member 122, the attitude control plate 123 remains in the position (contoured in solid line in FIG. 21) in which it completely blocks the path of the recording sheet 120.

As the leading edge of the recording sheet 120 reaches the attitude control plate 123 and pushes the attitude control plate 123, the attitude control plate 123 bends into the position (contoured in broken line in FIG. 21) in which it is out of the sheet conveyance path, because the attitude control plate 123 is elastic and easily flexible. In this state, the recording sheet 120 is kept pressed upward upon the feed roller 111 by the pressure generated in the upward direction by the resiliency of the elastic attitude control plate 123.

Therefore, the angle the recording sheet 120 forms relative to the peripheral surface of the separation roller 112 is kept relatively small, preventing a piece of card board as a recording medium, a curled recording sheet, or the like from failing to be properly fed.

Further, in the case of this embodiment, once the leading edge of the recording sheet 120 passes through the sheet separating portion, the force which applies to the upstream side of the recording sheet 120 with respect to the sheet separating portion, is only the force generated by the resiliency of the elastic attitude control plate 123, being therefore minute. Therefore, the friction between the recording sheet 120 and attitude control plate 123 remains virtually nil.

Embodiment 4

Figure 23:
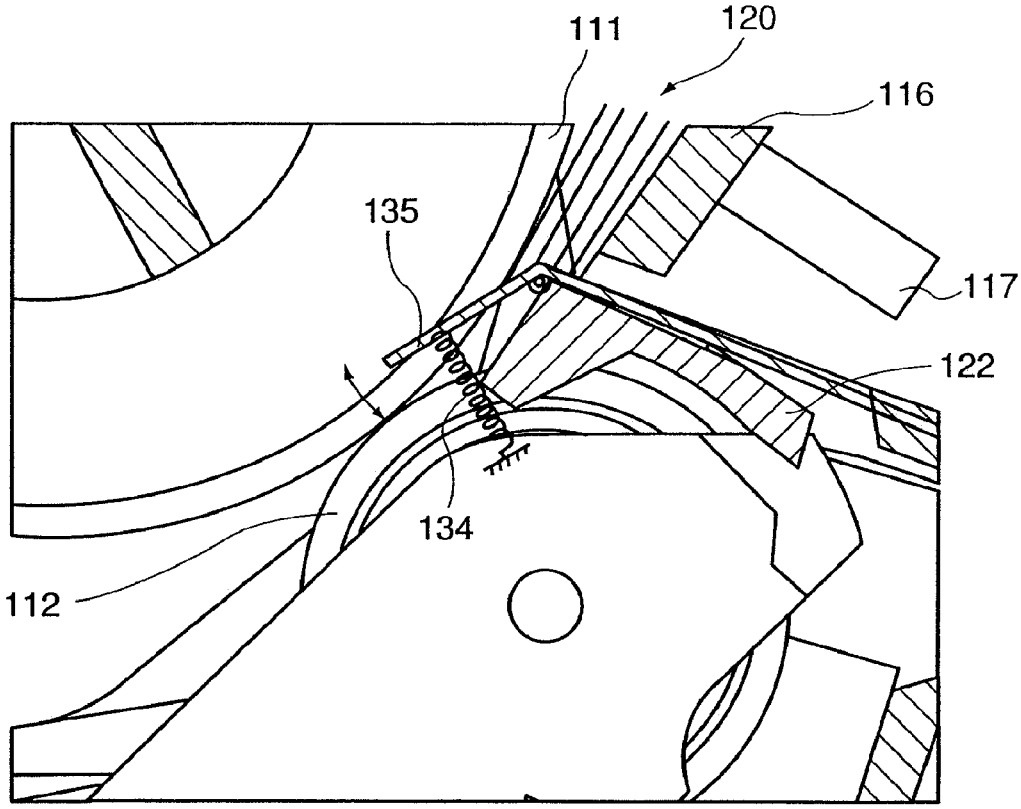
FIG. 23 is a schematic sectional view of the sheet separating portion of the third embodiment of a sheet feeding apparatus in accordance with the present invention.
Figure 24:
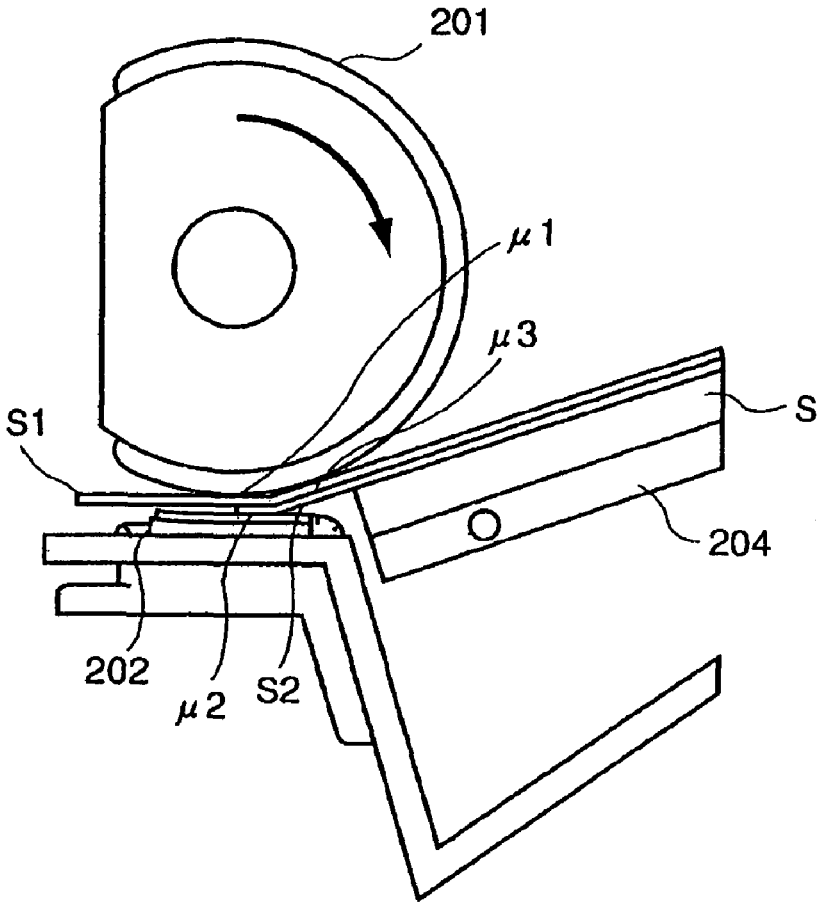
FIG. 24 PRIOR ART
FIG. 24 is a schematic drawing for describing a sheet feeding apparatus in accordance with the prior art.
Figure 25:
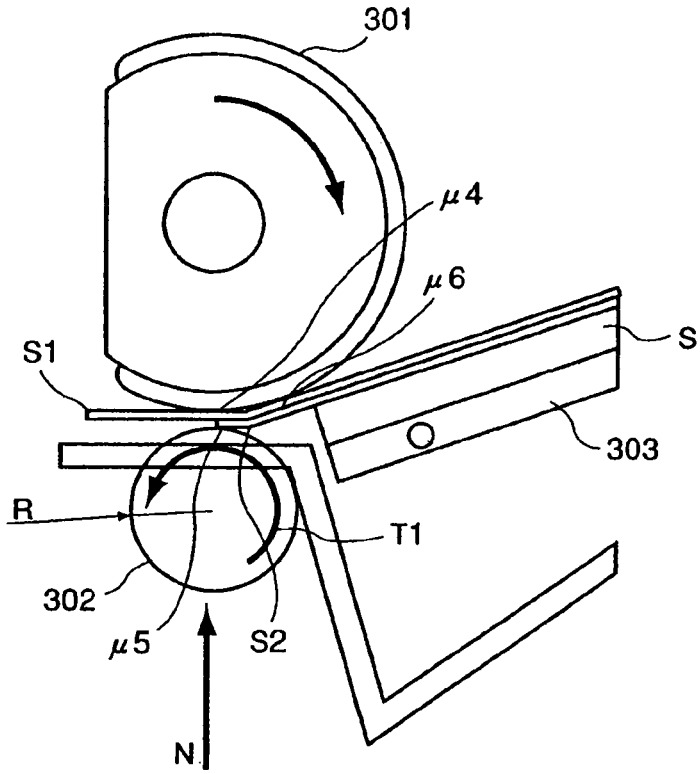
FIG. 25 PRIOR ART
FIG. 25 is a schematic drawing for describing another sheet feeding apparatus in accordance with the prior art.
Figure 26:
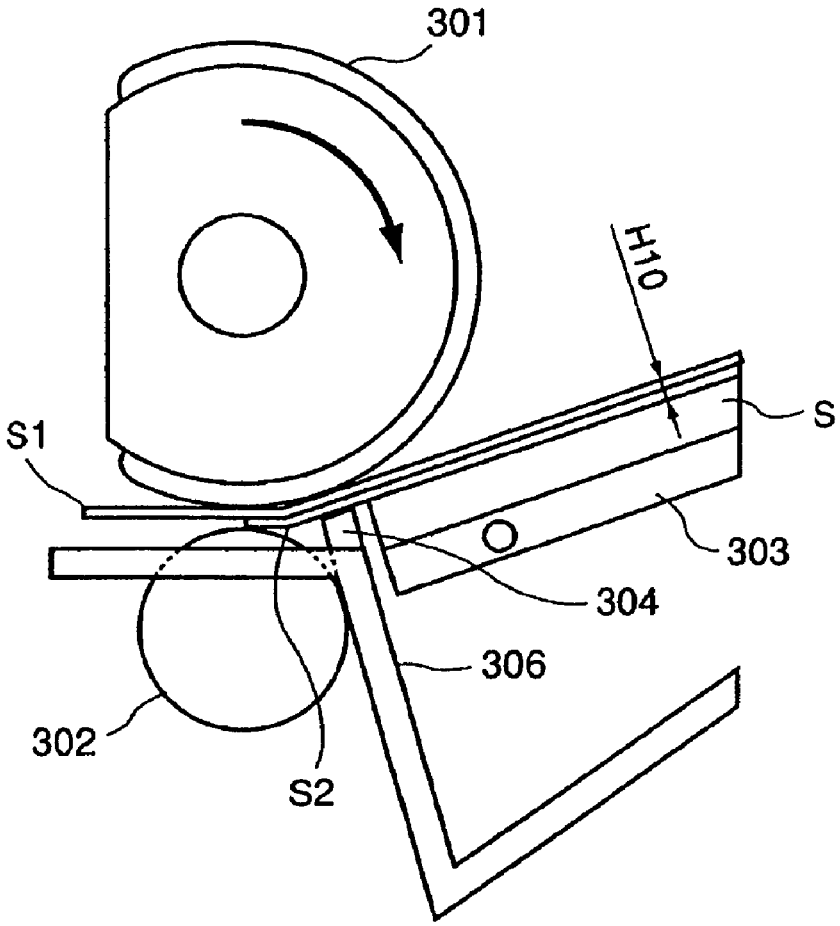
FIG. 26 PRIOR ART
FIG. 26 is a schematic drawing for describing yet another sheet feeding apparatus in accordance with the prior art.
Figure 27:
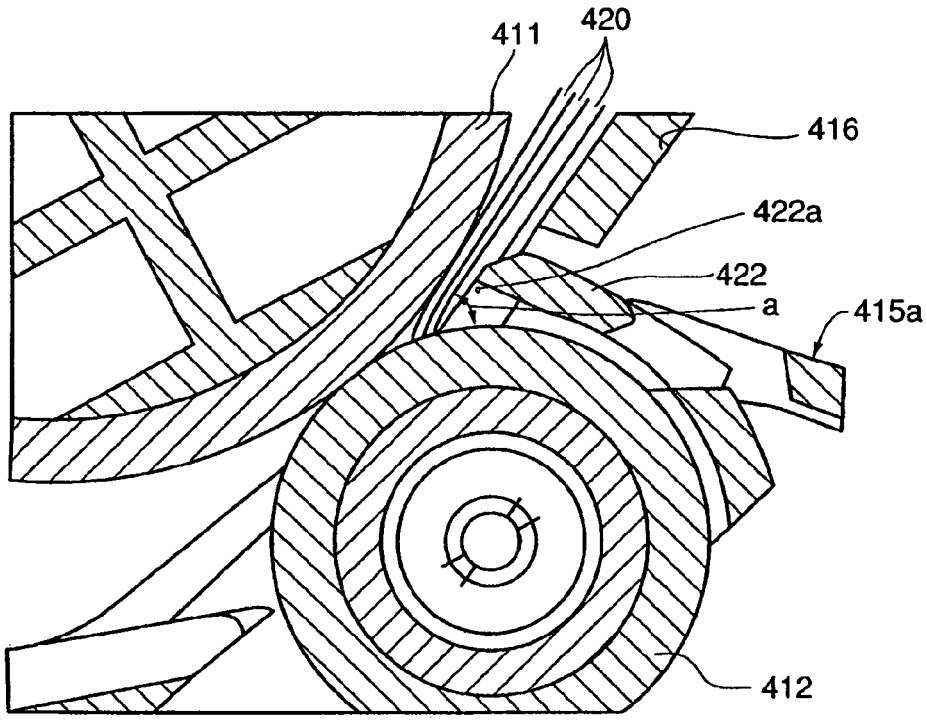
FIG. 27 PRIOR ART
FIG. 27 is a schematic sectional view of the sheet separating portion of a sheet feeding apparatus in accordance with the prior art.

Next, the fourth embodiment of a sheet feeding apparatus in accordance with the present invention will be described with reference to the appended drawings. FIG. 23 is a schematic sectional view of the sheet separating portion of this embodiment of a sheet feeding apparatus. The components in this embodiment of a sheet feeding apparatus similar in description to those in the above described second embodiment are given the same reference signs as those in the second embodiment, and their descriptions will be not be given here.

Referring to FIG. 23, this embodiment of a sheet feeding apparatus is similar to the third embodiment, except that this embodiment has a sheet attitude control plate 135 instead of the elastic sheet attitude control ribs 123 in the third embodiment. The sheet attitude control plate 135 is kept pressured upon the feed roller 111 by an attitude control spring 134 which is very small in the amount of the pressure it generates.

Until a recording sheet 120 reaches the preregulating member 122, the attitude control plate 135 remains in the position (contoured in solid line in FIG. 21) in which it completely blocks the path of the recording sheet 120.

As the leading edge of the recording sheet 120 reaches the attitude control plate 135 and pushes the attitude control plate 135, the attitude control plate 135 is made to retract from the sheet conveyance path by the advancing recording sheet 120, because the attitude control spring 134 is very weak. In this state, the recording sheet 120 is kept pressed upward upon the feed roller 111 by the attitude control plate 135.

Therefore, the angle the recording sheet 120 forms relative to the peripheral surface of the separation roller 112 is kept relatively small, preventing a piece of card board as a recording medium, a curled recording sheet, or the like, from failing to be properly fed.

Further, in the case of this embodiment, once the leading edge of the recording sheet 120 passes through the sheet separating portion, the force which applies to the upstream side of the recording sheet 120 with respect to the sheet separating portion, is only the force generated by the resiliency of the attitude control spring 134, being therefore minute. Therefore, the friction between the recording sheet 120 and attitude control plate 135 remains virtually nil.

With the provision of this structural arrangement, the friction between the upstream side of the recording sheet 120 with respect to the sheet separating portion, and the attitude control plate 135, can be controlled by adjusting the resiliency of the attitude control spring 134, making it possible to further reduce the friction between the recording sheet 120 and attitude control plate 135, compared to that in the third embodiment.

As described above, according to the present invention, a sheet feeding apparatus is provided with a sheet attitude controlling members for controlling the attitude assumed by a recording sheet when it is conveyed toward the sheet separating means. In terms of the widthwise direction of a recording sheet, the attitude controlling members are disposed out of the ranges in which the sheet feeding means and sheet separating means are present, so that the attitude controlling members do not interfere with the sheet feeding means and sheet separating means. The attitude controlling members are given such a height that their tips become even with the sheet conveyance path, or such a height that their tips protrude into the space on the sheet feeding means side, with respect to the sheet conveyance path.

This structural arrangement makes it easier to control the angle the leading edge portion of a recording sheet forms relative to the sheet separating means the moment the leading edge of the recording sheet comes into contact with the sheet separating means. Therefore, it is possible to prevent the problem that the collision between the leading edge of a recording sheet and a sheet separating means causes the recording sheet to fail to be properly fed. Further, it is possible to prevent the leading edge portion of a recording sheet from being folded backward, in the sheet separating portion. Moreover, recording sheets can be properly fed even in a recording apparatus, the sheet feeding tray of which is disposed virtually upright.

According to another aspect of the present invention, the preregulating member is formed as an integral part of the attitude controlling member, reducing the component count, hence, the apparatus cost.

According to another aspect of the present invention, the preregulating member and attitude controlling member are formed as integral parts of a single component, and are made movable independently of the separating means holding member. Therefore, even if a recording sheet is stuck between the preregulating member and feed roller, it can be easily extracted, and also, the force necessary to drive the recording sheet returning means is smaller. Further, even if the preregulating member is forced to move by a large number of recording sheets accidentally entering between the preregulating member and feed roller, the sheet separating portion is not affected by such an accident.

According to another aspect of the present invention, the preregulating member, attitude control member, and separating means holding member, are formed as integral parts of a single component, reducing the component count, hence, cost, while providing the same effects as those provided by the preceding aspects of the present invention.

According to another aspect of the present invention, the height of the attitude control member gradually increases from the end closest to the sheet separating means toward the end opposite to the sheet separating means, ensuring that a recording sheet is not prevented by the contact between the leading edge of the recording sheet and the sheet separating means, from being advanced.

According to another aspect of the present invention, the attitude control member for preventing a recording sheet from failing to be advanced is made up of a set of ribs, simplifying attitude control member in structure.

According to another aspect of the present invention, the attitude control member for preventing a recording sheet from failing to be advanced is formed of an elastic substance, simplifying the attitude control member in structure, as well as minimizing the friction between the recording sheet and attitude control member.

According to another aspect of the present invention, a rotatable member, the external diameter of which is no more than 34 mm, is employed as the sheet feeding means, and a sheet separating roller, which has a torque limiter, and the external diameter of which is no more than 25 mm, is employed as the sheet separating means, reducing the size of a sheet feeding apparatus while assuring the sheet separating performance.

According to another aspect of the present invention, a separation pad having a frictional member is employed as the sheet separating means, simplifying the sheet separating means in structure.

While the invention has been described with reference to the structures disclosed herein, it is not confined to the details set forth, and this application is intended to cover such modifications or changes as may come within the purposes of the improvements or the scope of the following claims.

What is claimed is:

1. A sheet feeding apparatus comprising:

a stacker for stacking sheet materials;

a feeding roller for feeding sheet materials from the stacker;

separating means, contactable to the sheet materials fed by said feeding roller, for separating the sheets one by one, wherein the feeding roller and the seperating means form a nip; and a first contact portion and a second contact portion which are contactable to the sheet at respective lateral sides of said feeding roller at upstream positions with respect to a feeding direction of the nip, wherein said first and second contact portions are contactable to the sheet at a side of the sheet opposite to a side thereof to which said feeding roller contacts, and wherein distances between a rotational axis of said feeding roller and said first and second contact portions are not longer than the distance between the rotational axis of said feeding roller and an outer peripheral surface of said feeding roller which is contactable to the sheet, wherein said first and second contact portions are contacted to the sheet at positions downstream of said stacker with respect to the feeding direction.

2. An apparatus according to claim 1, wherein a leading end of the sheet is brought into contact to said separating means with a state in which the sheet is curved with respect to a widthwise direction thereof, by the sheet contacting to said feeding roller and to said first and second contact portions.

3. An apparatus according to claim 2, wherein the sheet is curved convex toward said separating means.

4. An apparatus according to claim 1, wherein said first and second contact portions comprise rib like members.

5. An apparatus according to claim 1, wherein said first and second contact members comprise elastic members.

6. An apparatus according to claim 1, wherein said separating means includes a separation roller provided with a torque limiter.

7. An apparatus according to claim 1, wherein said separating means includes a separation pad provided with a friction member.

8. A recording apparatus comprising a sheet feeding apparatus according to claim 1, and recording means for effecting recording on the sheet fed by said sheet material feeding apparatus.

* * * * *